US009715210B2

(12) United States Patent
Miyoshi et al.

(10) Patent No.: US 9,715,210 B2
(45) Date of Patent: Jul. 25, 2017

(54) MAIN BODY OF IMAGE FORMING APPARATUS

(71) Applicant: CANON KABUSHIKI KAISHA, Tokyo (JP)

(72) Inventors: Takahiro Miyoshi, Yokohama (JP); Masatoshi Takiguchi, Yokohama (JP); Tachio Kawai, Tokyo (JP); Shunsuke Uratani, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/014,549

(22) Filed: Feb. 3, 2016

(65) Prior Publication Data

US 2016/0231698 A1 Aug. 11, 2016

(30) Foreign Application Priority Data

Feb. 6, 2015 (JP) ..... 2015-022677

(51) Int. Cl.
*G03G 21/18* (2006.01)
*G03G 21/16* (2006.01)

(52) U.S. Cl.
CPC ..... *G03G 21/1842* (2013.01); *G03G 21/1623* (2013.01); *G03G 21/1647* (2013.01); *G03G 21/1896* (2013.01); *G03G 2221/1696* (2013.01)

(58) Field of Classification Search
CPC ..... G03G 21/1619; G03G 21/1623; G03G 21/18; G03G 21/1839; G03G 21/1842; G03G 21/1853; G03G 2221/16; G03G 2221/1678; G03G 2221/18; G03G 2221/1884; G03G 21/1647; G03G 21/1896; G03G 2221/1696
USPC ..... 399/107, 110, 111
See application file for complete search history.

(56) References Cited

U.S. PATENT DOCUMENTS

| | | | | |
|---|---|---|---|---|
| 7,711,287 | B2 * | 5/2010 | Kimizuka | G03G 21/1853 399/111 |
| 8,331,829 | B2 * | 12/2012 | Mase | G03G 15/0877 399/120 |
| 2003/0091361 | A1 * | 5/2003 | Noda | G03G 21/1871 399/111 X |
| 2003/0161654 | A1 * | 8/2003 | Yokomori | G03G 21/1864 399/111 |
| 2006/0067733 | A1 * | 3/2006 | Kawasumi | G03G 21/1853 399/111 |
| 2011/0170905 | A1 * | 7/2011 | Furuya | G03G 21/1853 399/111 |
| 2015/0205256 | A1 * | 7/2015 | Matsumaru | G03G 21/1814 399/111 |

FOREIGN PATENT DOCUMENTS

| | | |
|---|---|---|
| JP | 2005148319 A | 6/2005 |
| JP | 2010276961 A | 12/2010 |

* cited by examiner

*Primary Examiner* — Sophia S Chen
(74) *Attorney, Agent, or Firm* — Canon U.S.A. Inc., IP Division

(57) ABSTRACT

In order to enable a main body of an image forming apparatus to selectively attach and detach a first cartridge group and a second cartridge group, a first guide for positioning the first cartridge group to the main body of the image forming apparatus and a second guide for positioning the second cartridge group to the main body of the image forming apparatus are detachably attachable to the main body of the image forming apparatus.

14 Claims, 27 Drawing Sheets

MAIN BODY OF IMAGE FORMING APPARATUS

BACKGROUND OF THE INVENTION

Field of the Invention

The present invention relates a main body of an image forming apparatus adopting an electrophotographic image forming method.

Description of the Related Art

Conventionally, image forming apparatuses adopt cartridge methods in which drums and process units acting on the drums are integrally formed as cartridges, and the cartridges are detachably attachable to main bodies of the image forming apparatuses. The cartridge methods enable users to do maintenance of the image forming apparatuses by themselves without asking service persons, so that operability of the apparatuses can be significantly improved. Thus, the cartridge methods are widely used in the image forming apparatuses.

Nowadays, popularization of computers enables a broad range of users to use printers, facsimiles, and others. As for cartridges as consumables, there is a need of users to use cartridges having forms corresponding to usage with respect to the apparatus main bodies. An apparatus is discussed which can attach and detach a separate type cartridge which is different from a process cartridge in which consumables are unified into an integrated structure and is constituted of a drum cartridge including a photosensitive drum and a developing cartridge including a developing unit (Japanese Patent Application Laid-Open No. 2010-276961).

As for a configuration of the apparatus which mounts the separate type cartridge, a configuration is discussed in which the apparatus main body includes a fixed guide and a rotation guide. In the configuration, the drum cartridge is mounted to the fixed guide which is fixed to and supported by the apparatus main body, and the developing cartridge is mounted to the rotation guide which is rotatably supported by the apparatus main body. In the image forming apparatus, the photosensitive drum included in the drum cartridge is brought into contact with the developing unit included in the developing cartridge by rotating the rotation guide to form an image (Japanese Patent Application Laid-Open No. 2005-148319).

SUMMARY OF THE INVENTION

An image forming apparatuses which can mount a separate type cartridge thereto can only mount a cartridge having a specific form, such as the separate type cartridge, to an apparatus main body up to now. More specifically, in order to change a form of a cartridge, it is necessary to largely change layout of members related to image forming in the image forming apparatus which causes difficulty in design. Accordingly, the image forming apparatus has not been able to satisfactorily meet the needs to use a cartridge having a form corresponding to usage with respect to the apparatus main body.

An aspect of the present invention is directed to a main body of an image forming apparatus which is selectively detachably attachable a first cartridge group and a second cartridge group thereto. The first cartridge group includes a first drum cartridge including a first photosensitive drum and a first developing roller which is a separate body from the first drum cartridge and includes a first developing cartridge. The second cartridge group includes a second drum cartridge including a second photosensitive drum and a second developing cartridge which is a separate body from the second drum cartridge and includes a second developing roller. The main body of the main body of the image forming apparatus includes an exposure unit configured to form an electrostatic latent image on the first photosensitive drum or the second photosensitive drum. Further, a first guide configured to position the first cartridge group to the main body of the image forming apparatus and a second guide configured to position the second cartridge group to the main body of the image forming apparatus are detachably attachable to the main body of the image forming apparatus.

Another aspect of the present invention is directed to a main body of an image forming apparatus which is selectively detachably attachable a second cartridge group and a third cartridge group thereto. The second cartridge group includes a second drum cartridge including a second photosensitive drum and a second developing cartridge which is a separate body from the second drum cartridge and includes a second developing roller. The third cartridge group includes a first process cartridge in which a first photosensitive member unit including a third photosensitive drum and a first developing unit including a third developing roller are unified. The main body of the image forming apparatus includes an exposure unit configured to form an electrostatic latent image on the second photosensitive drum or the third photosensitive drum. Further, a second guide configured to position the second cartridge group to the main body of the image forming apparatus and a third guide configured to position the third cartridge group to the main body of the image forming apparatus are detachably attachable to the main body of the image forming apparatus.

Further another aspect of the present invention is directed to a main body of an image forming apparatus which is selectively detachably attachable a third cartridge group and a fourth cartridge group thereto. The third cartridge group includes a first process cartridge in which a first photosensitive member unit including a third photosensitive drum and a first developing unit including a third developing roller are unified so as to enable at least one of abutment and separation between the third photosensitive drum and the third developing roller by rotating by a third rotation shaft. The fourth cartridge group includes a second process cartridge in which a second photosensitive member unit including a fourth photosensitive drum and a second developing unit including a fourth developing roller are unified so as to enable at least one of abutment and separation between the fourth photosensitive drum and the fourth developing roller by rotating by a fourth rotation shaft. The main body of the image forming apparatus includes an exposure unit configured to form an electrostatic latent image on the third photosensitive drum or the fourth photosensitive drum. A third guide which is provided with a third drum guiding portion engaging with a third positioning portion provided on a third bearing supporting the third photosensitive drum and a third developing guiding portion engaging with a third engagement portion of the first developing unit and fixed to the main body of the image forming apparatus and a fourth guide which is provided with a fourth drum guiding portion engaging with a fourth positioning portion provided on a fourth bearing supporting the fourth photosensitive drum and a fourth developing guiding portion engaging with a fourth engagement portion of the second developing unit and fixed to the main body of the image forming apparatus are detachably attachable to the main body of the image forming apparatus. The third guide and the fourth guide are configured to be mountable so that the third rotation shaft and the fourth rotation shaft are on a same line in the main body of the image forming apparatus.

Further features of the present invention will become apparent from the following description of exemplary embodiments with reference to the attached drawings.

DESCRIPTION OF THE EMBODIMENTS

Figure 1:
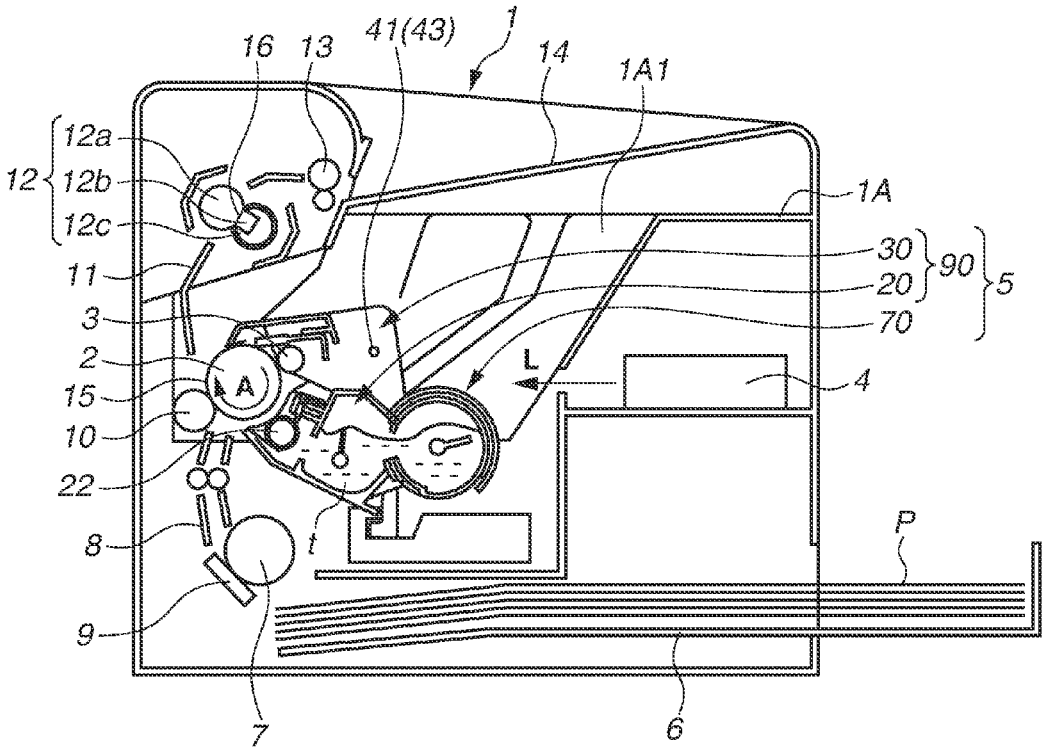
FIG. 1 is a cross-sectional view of an image forming apparatus to which a first cartridge group according to an exemplary embodiment is mounted.

First, an entire configuration of the present exemplary embodiment is described with reference to FIG. 1. An image forming apparatus 1 illustrated in FIG. 1 forms an image by a developer on a recording medium P using an electrophotographic image forming process according to image information from an external apparatus, such as a personal computer, communicably connected to the image forming apparatus 1. The recording medium P may be, for example, a recording sheet, an overhead projector (OHP) sheet, a cloth, and the like. FIG. 1 illustrates the image forming apparatus 1 in which a first cartridge group 5 constituted of a process cartridge 90 and a toner cartridge 70 is mounted to an apparatus main body 1A.

The apparatus main body 1A includes a pickup roller 7, a conveyance guide 8, a press-contact member 9, a transfer roller 10, a fixing unit 12, and a pair of discharge rollers 13. In the image forming apparatus 1, an image forming process is performed as described below.

First, a photosensitive drum 2 is rotated to a direction of an arrow A so that a surface of the photosensitive drum 2 is uniformly charged by a charging roller 3 serving as a charging unit. An optical unit (an exposure unit) 4 irradiates the photosensitive drum 2 with a laser beam L corresponding to image information to form an electrostatic latent image corresponding to the image information on the photosensitive drum 2. The electrostatic latent image formed on the photosensitive drum 2 is developed by a developing roller 22 serving as a developing unit and toner t, so that a toner image is formed.

On the other hand, in synchronization with formation of the toner image, the recording medium P set in a sheet cassette 6 is picked up and fed one by one by the pickup roller 7 and the press-contact member 9 pressing and contacting therewith. The recording medium P is conveyed along the conveyance guide 8 to the transfer roller 10 serving as a transfer unit. Next, the recording medium P passes through a transfer nip portion 15 formed by the photosensitive drum 2 and the transfer roller 10 to which a constant voltage is applied. At that time, the toner image formed on the photosensitive drum 2 is transferred to the recording medium P. The recording medium P to which the toner image is transferred is conveyed by a conveyance guide 11 to the fixing unit 12. The fixing unit 12 includes a drive roller 12*a* and a fixing roller 12*c* incorporating a heater 12*b*. The fixing unit 12 applies heat and pressure to the recording medium P passing through a nip portion 16 formed by the fixing roller 12*c* and the drive roller 12*a* and fixes the transferred toner image on the recording medium P. Then, the recording medium P is conveyed by a pair of the discharge rollers 13 and discharged to a discharge tray 14.

(Configuration of First Cartridge Group)

Figure 2:
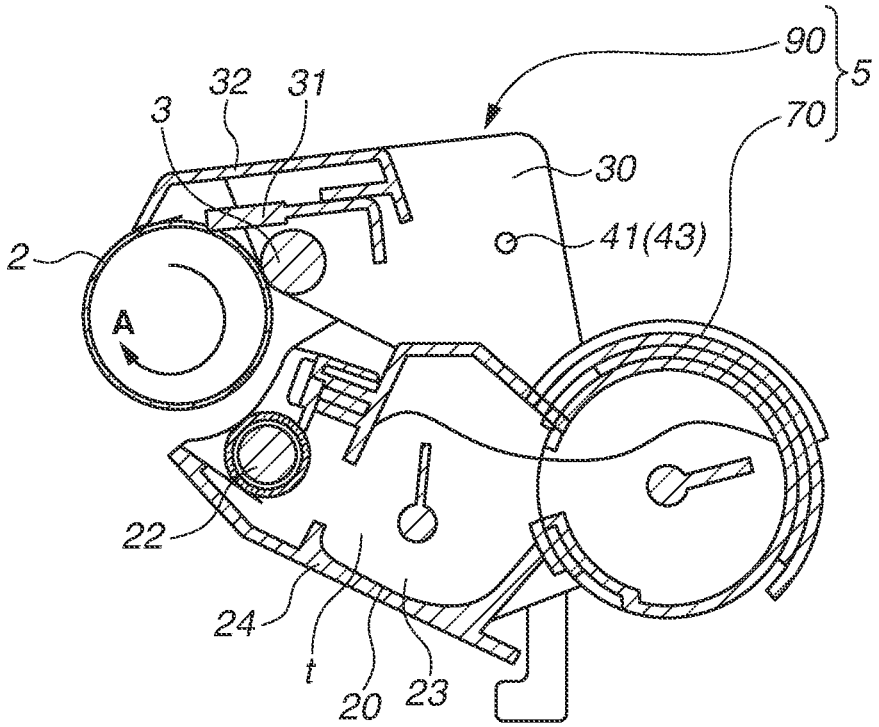
FIG. 2 is a cross-sectional view of the first cartridge group according to the exemplary embodiment.
Figure 3:
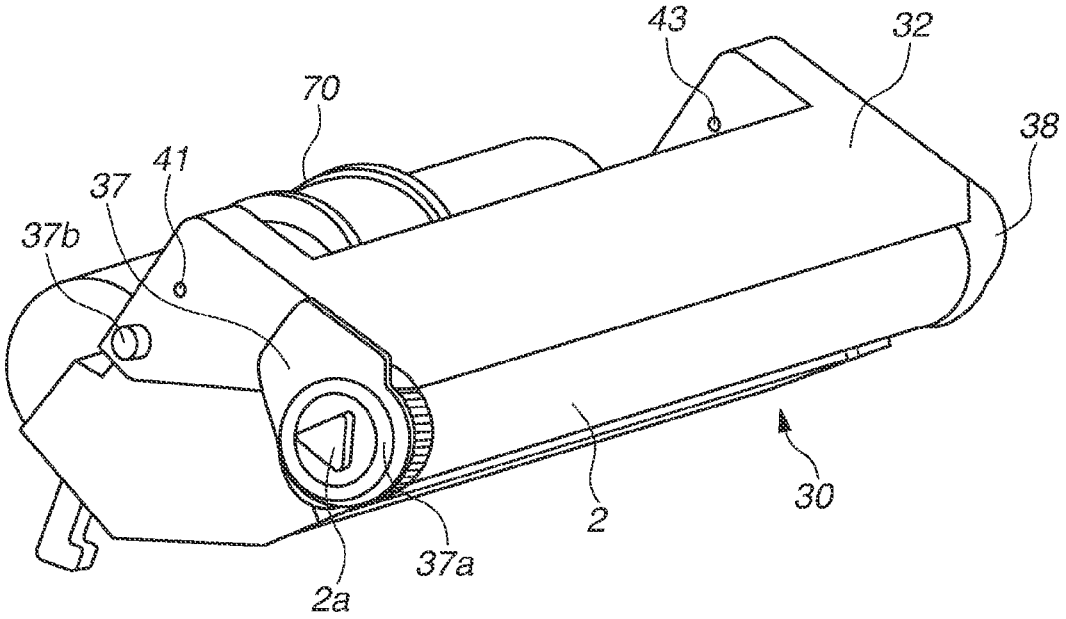
FIG. 3 is a perspective view of the first cartridge group according to the exemplary embodiment.
Figure 4:
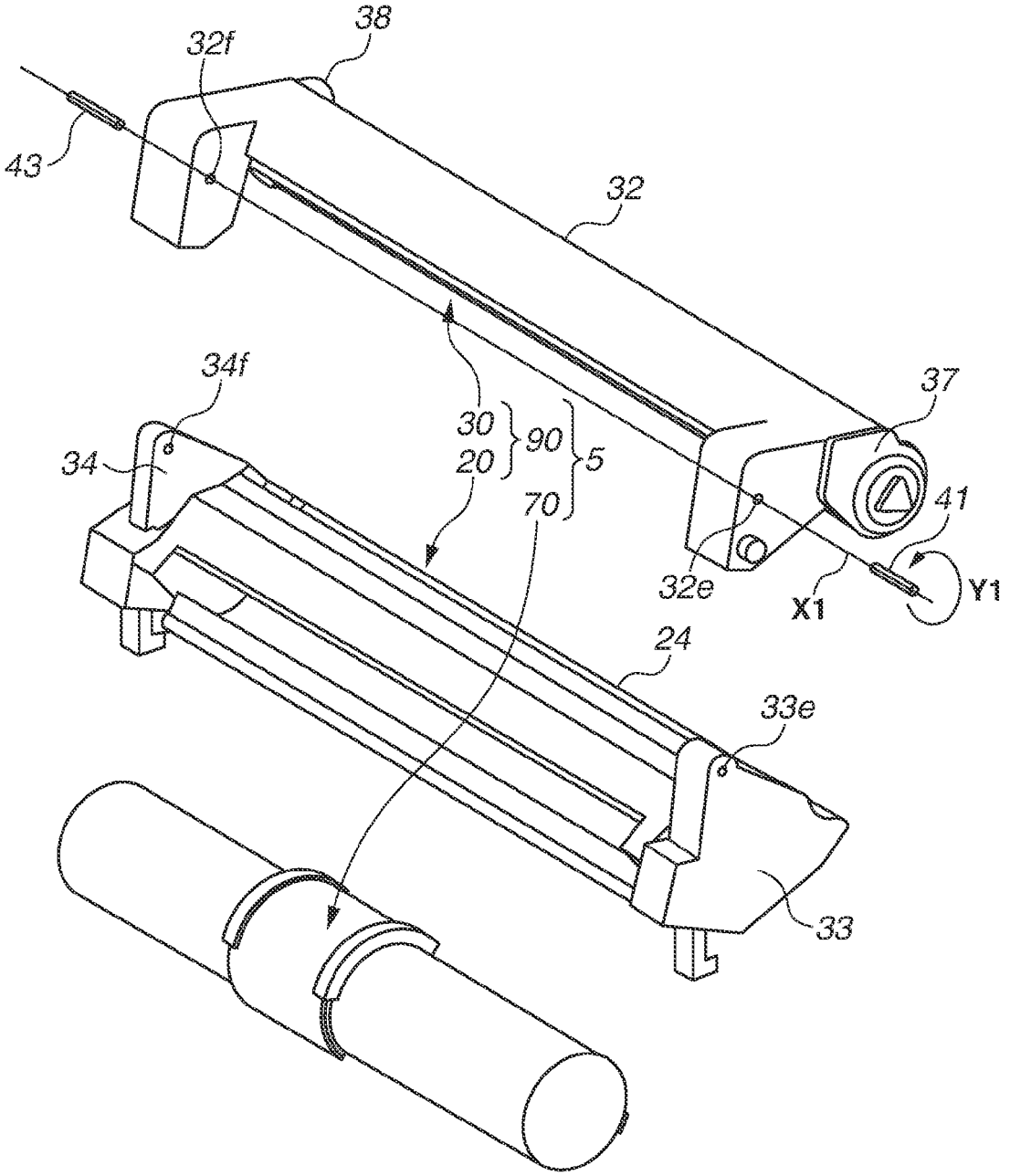
FIG. 4 is an exploded perspective view of the first cartridge group according to the exemplary embodiment.

Next, the first cartridge group 5 which is detachably attachable to the apparatus main body 1A of the image forming apparatus 1 according to the present exemplary embodiment is described with reference to FIGS. 2, 3, and 4. FIG. 2 is a schematic cross-sectional view of a configuration of the first cartridge group 5. FIG. 3 is a perspective view of the first cartridge group 5. FIG. 4 illustrates a state in which the first cartridge group 5 is broken down into the process cartridge 90 and the toner cartridge 70, and the process cartridge 90 is further broken into a developing unit 20 and a photosensitive member unit 30. As illustrated in FIG. 2, the first cartridge group 5 includes the process cartridge 90 in which the photosensitive member unit 30 and the developing unit 20 are unified and the toner cartridge 70 for storing the toner t. The process cartridge 90 is detachably attachable to the apparatus main body 1A, and the toner cartridge 70 is detachably attachable to the process cartridge 90. In the process cartridge 90, the developing unit 20 including the developing roller 22 is swingably attached to the photosensitive member unit 30 including the photosensitive drum 2.

The photosensitive member unit 30 includes a cleaning frame 32, the photosensitive drum 2 (see FIG. 2), a drive side drum bearing 37, a non-drive side drum bearing 38, the charging roller 3, and a cleaning unit 31. The photosensitive drum 2 is rotatably attached to the cleaning frame 32 via the drive side drum bearing 37 and the non-drive side drum bearing 38. A drive input unit 2*a* disposed on one end of the photosensitive drum 2 in a longitudinal direction engages with a drive output unit (not illustrated) of the apparatus main body 1A and receives a driving force from a drive motor (not illustrated) of the apparatus main body 1A. Accordingly, the photosensitive drum 2 is driven to rotate to the direction of the arrow A in response to an image forming operation (see FIG. 2).

The developing unit 20 includes a developing frame 24, the developing roller 22, a drive side developing bearing 33, a non-drive side developing bearing 34, and a toner chamber for storing the toner t as illustrated in FIGS. 2 and 4. The developing roller 22 is rotatably attached to the developing frame 24 via the drive side developing bearing 33 and the non-drive side developing bearing 34.

As illustrated in FIG. 4, the developing unit 20 is supported by the photosensitive member unit 30. More specifically, the cleaning frame 32 of the photosensitive member unit 30 is provided with a supporting hole 32*e* and a supporting hole 32*f* so that openings of the holes exist on a straight line. In addition, end portions of the developing frame 24 of the developing unit 20 are respectively provided with the drive side developing bearing 33 and the non-drive side developing bearing 34, and a supporting hole 33*e* of the drive side developing bearing 33 and a supporting hole 34*f* of the non-drive side developing bearing 34 are provided so that openings of the holes exist on a straight line.

On the drive side of the process cartridge 90 in the longitudinal direction, a connecting shaft 41 is inserted into the supporting hole 32*e* of the cleaning frame 32 and the supporting hole 33*e* of the drive side developing bearing 33. On the non-drive side of the process cartridge 90 in the longitudinal direction, a connecting shaft 43 is inserted into the supporting hole 32*f* of the cleaning frame 32 and the supporting hole 34*f* of the non-drive side developing bearing 34. Accordingly, the developing unit 20 is rotatably supported in a Y1 direction with respect to the photosensitive member unit 30. This rotation axis is defined as a rotation axis line X1 of the developing unit 20 with respect to the photosensitive member unit 30.

(Configuration of Guiding Unit)

Figure 5:
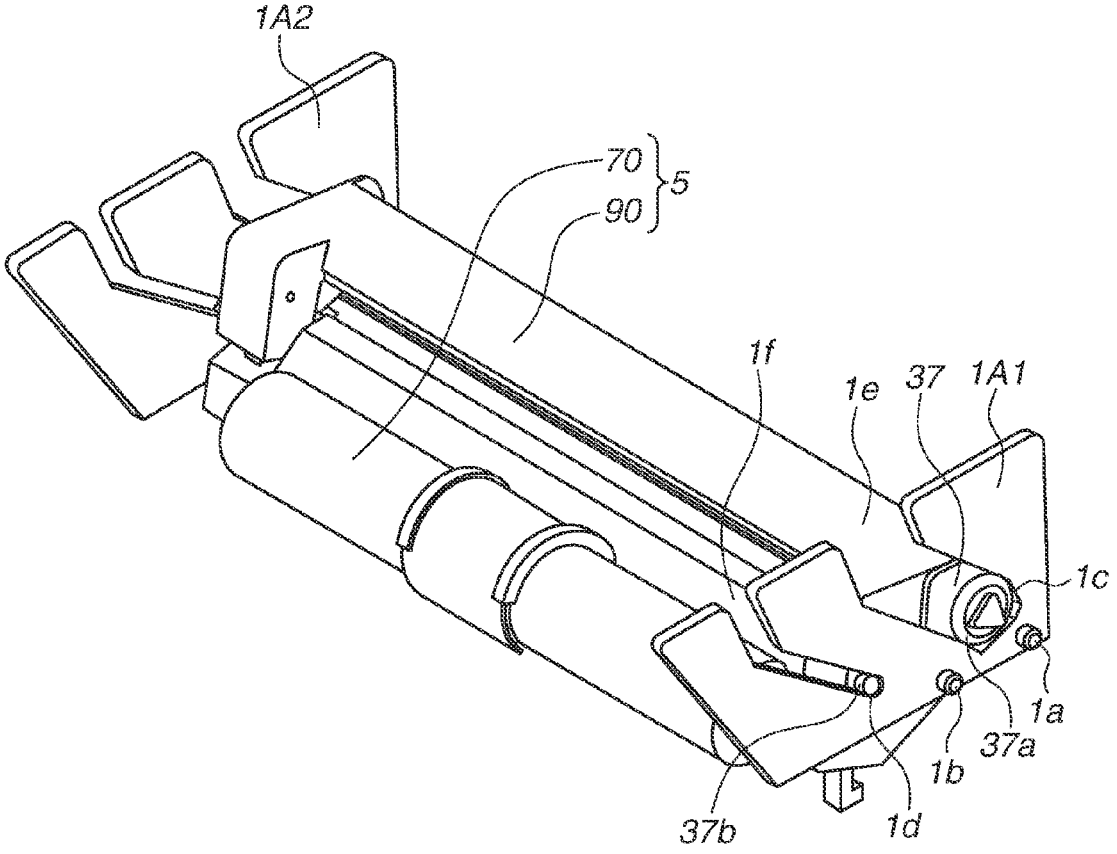
FIG. 5 is a perspective view of a first guide and the first cartridge group according to the exemplary embodiment.
Figure 6:
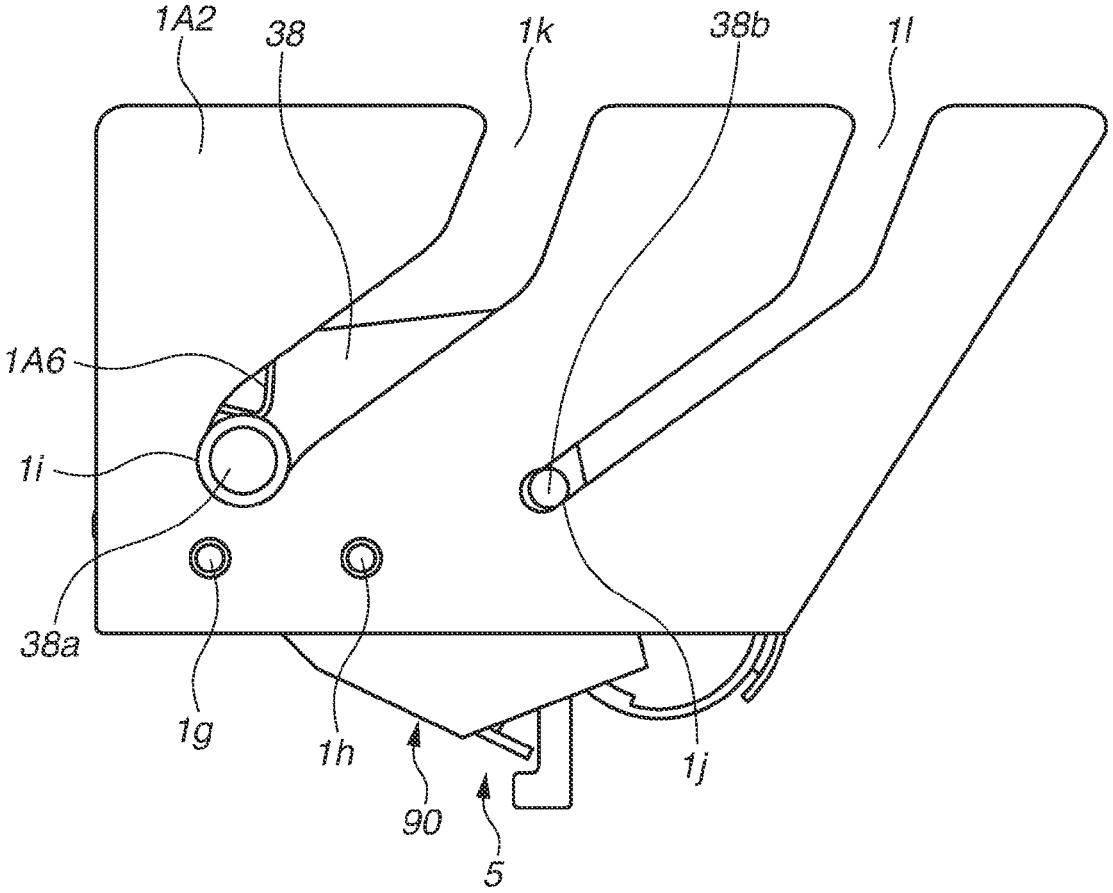
FIG. 6 is a side view of the first guide and the first cartridge group according to the exemplary embodiment.
Figure 7A:
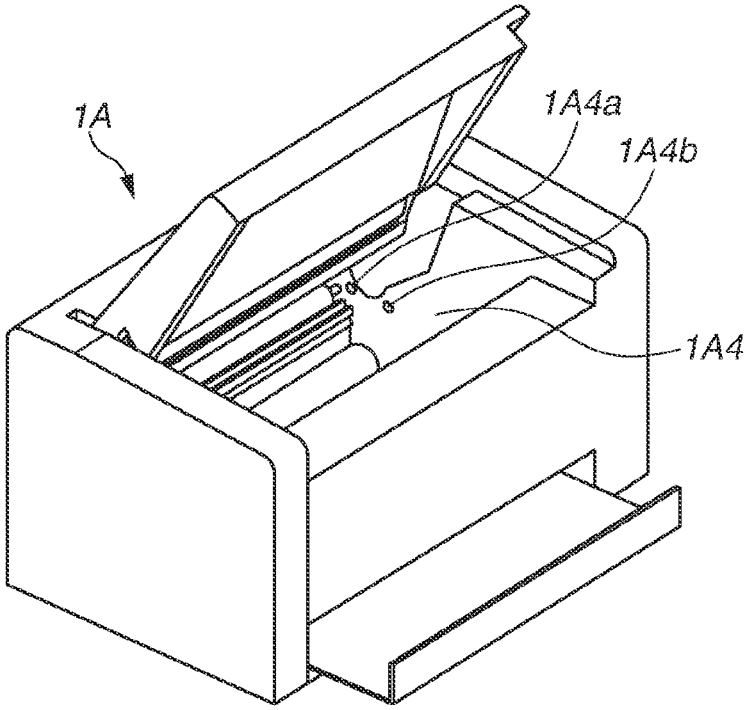
FIGS. 7A and 7B are perspective views of a main body of the image forming apparatus according to the exemplary embodiment.
Figure 7B:
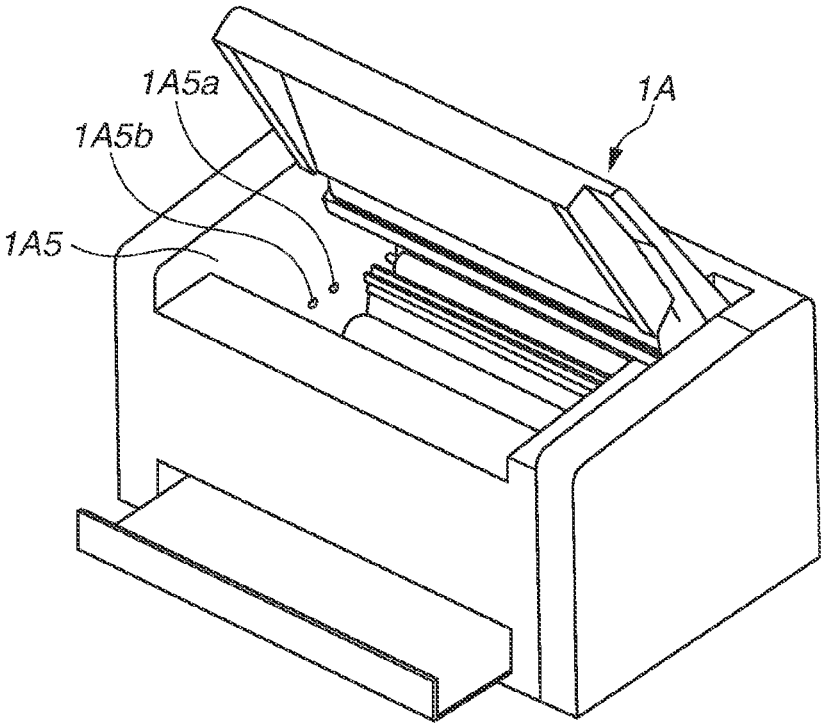

Next, a configuration of a guiding unit when the first cartridge group 5 is attached to and detached from the apparatus main body 1A is described with reference to FIGS. 5, 6, 7A and 7B. FIG. 5 is a perspective view of a state in which the first cartridge group 5 is guided by a drive side first guide 1A1 and a non-drive side first guide 1A2 and mounted to the apparatus main body 1A. FIG. 6 is a side view of the first cartridge group 5 and the non-drive side first guide 1A2 in a state in which the first cartridge group 5 is mounted to the apparatus main body 1A. FIGS. 7A and 7B are perspective views of a side plate 1A4 and a side plate 1A5 of the apparatus main body 1A in a state in which the drive side first guide 1A1 and the non-drive side first guide 1A2 are not attached.

As illustrated in FIGS. 5 and 6, the guiding unit (the first guide) fixed to the apparatus main body 1A is constituted of the drive side first guide 1A1 and the non-drive side first guide 1A2. When the first cartridge group 5 is mounted to the apparatus main body 1A, the drive side first guide 1A1 of the process cartridge 90 is disposed so as to face the drive side drum bearing 37. Similarly, the non-drive side first guide 1A2 of the process cartridge 90 is disposed so as to face the non-drive side drum bearing 38.

The drive side first guide 1A1 is formed by a plate member and provided with a positioned portion 1*a* and a rotation regulated portion 1*b* which have protruded boss shapes and a drum guiding portion 1*e* and a developing guiding portion 1*f* which have groove shapes (FIG. 5). On the other hand, on the drive side, a drive side side plate 1A4 of the apparatus main body 1A is provided with a positioning portion 1A4*a* and a rotation regulating portion 1A4*b* which have concave shapes, such as holes, as illustrated in FIG. 7A. The positioned portion 1*a* engages with the positioning portion 1A4*a*, and the rotation regulated portion 1*b* engages with the rotation regulating portion 1A4*b*, so that the drive side first guide 1A1 is supported by and fixed to the apparatus main body 1A.

The drive side first guide 1A1 fixed to the apparatus main body 1A is configured to guide the first cartridge group 5 by the drum guiding portion 1*e* and the developing guiding portion 1*f* when the process cartridge 90 is mounted to the apparatus main body 1A. More specifically, the drive side drum bearing 37 is provided with a first guided portion 37*a* (the positioning portion) and a second guided portion 37*b* (the rotation regulating portion) which are formed so as to include a bearing portion of the photosensitive drum 2. In addition, the first guided portion 37*a* is configured to engage with the drum guiding portion 1*e*, and the second guided portion 37*b* is configured to engage with the developing guiding portion 1*f*. A spring, not illustrated, urges the first guided portion 37*a* toward a drive side positioning portion 1*c* and urges the second guided portion 37*b* toward a drive side rotation regulating portion 1*d* so as to regulate movement of the photosensitive member unit 30 from a mounting position.

Similar to the drive side first guide 1A1, the non-drive side first guide 1A2 is formed by a plate member and provided with a positioned portion 1*g* and a rotation regulated portion 1*h* which have protruded boss shapes and a drum guiding portion 1*k* and a developing guiding portion 1*l* which have groove shapes (FIG. 6). On the other hand, on the non-drive side, a non-drive side side plate 1A5 of the apparatus main body 1A is provided with a positioning portion 1A5*a* and a rotation regulating portion 1A5*b* which have concave shapes, such as holes, as illustrated in FIG. 7B. The positioned portion 1*g* engages with the positioning portion 1A5*a*, and the rotation regulated portion 1*h* engages with the rotation regulating portion 1A5*b*, so that the non-drive side first guide 1A2 is supported by and fixed to the apparatus main body 1A.

The non-drive side first guide 1A2 fixed to the apparatus main body 1A is configured to guide the first cartridge group 5 by the drum guiding portion 1*k* and the developing guiding portion 1*l* when the first cartridge group 5 is mounted to the apparatus main body 1A. More specifically, the non-drive side drum bearing 38 is provided with a third guided portion 38*a* (the photosensitive member positioning portion) and a fourth guided portion 38*b* (the rotation regulating portion) which are formed so as to include the bearing portion of the photosensitive drum 2. In addition, the third guided portion 38*a* is configured to engage with the drum guiding portion 1*k*, and the fourth guided portion 38*b* is configured to engage with the developing guiding portion 1*l*. A spring 1A6 urges the third guided portion 38*a* toward a non-drive side positioning portion 1*i* and urges the fourth guided portion 38*b* toward a non-drive side rotation regulating portion 1*j* so as to regulate the movement of the photosensitive member unit 30 from the mounting position.

As described above, the first cartridge group 5 can be guided to the mounting position of the apparatus main body 1A by the drive side first guide 1A1 and the non-drive side first guide 1A2 fixed to the apparatus main body 1A, the drive side drum bearing 37, and the non-drive side drum bearing 38.

(Abutment and Separation Method)

Figure 8A:
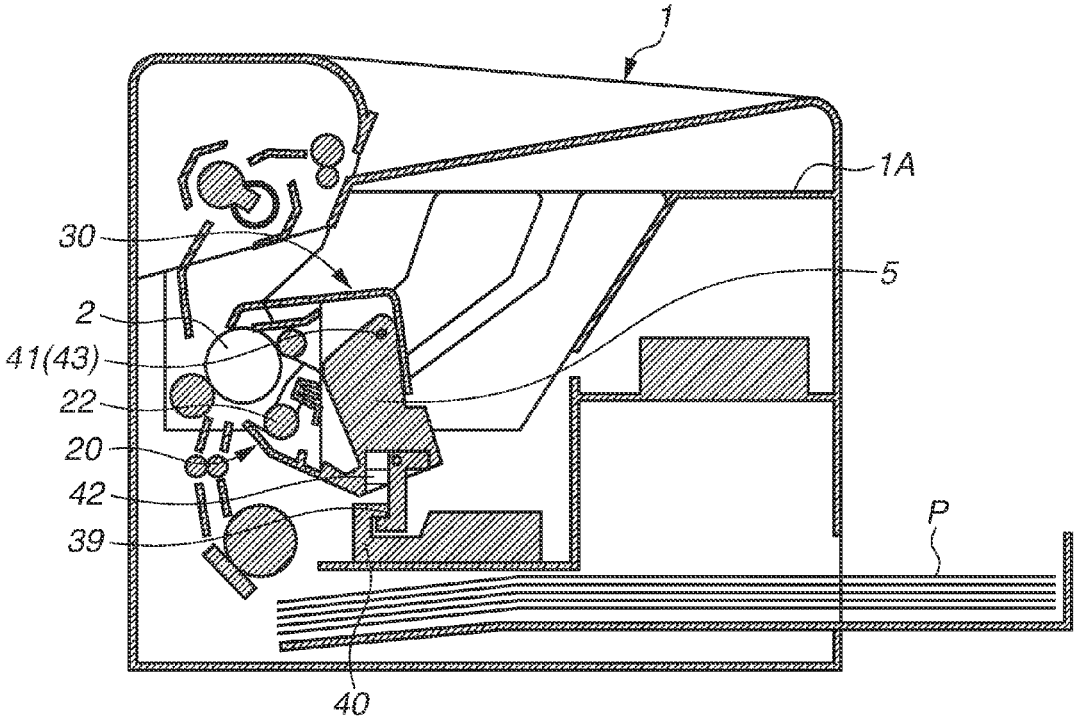
FIGS. 8A and 8B are cross-sectional views of the image forming apparatus to which a second cartridge group according to the exemplary embodiment is mounted.
Figure 8B:
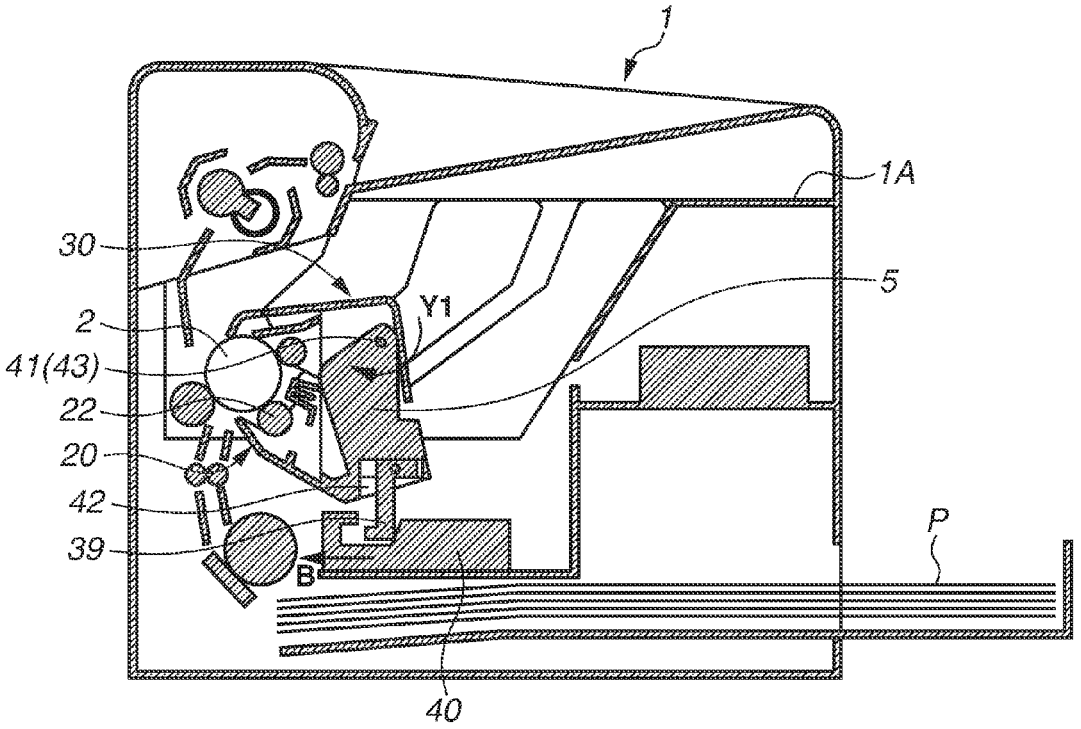

Next, abutment and separation of the photosensitive drum 2 and the developing roller 22 of the process cartridge 90 is described. In the image forming apparatus 1, the photosensitive drum 2 and the developing roller 22 abut with each other only when an image is transferred to the recording medium P, and other than that, the photosensitive drum 2 and the developing roller 22 are separated from each other. The abutment and separation method is described with reference to FIGS. 8A and 8B. FIGS. 8A and 8B are cross-sectional views of the apparatus main body 1A to which the first cartridge group 5 is mounted. FIG. 8A illustrates a state in which the developing roller 22 is separated from the photosensitive drum 2. FIG. 8B illustrates a state in which the developing roller 22 abuts against the photosensitive drum 2 in image forming.

When a job signal is input to the apparatus main body 1A in the separated state illustrated in FIG. 8A, a pressing lever 40 of the apparatus main body 1A is urged to a direction of an arrow B (FIG. 8B). The pressing lever 40 urges a pressed member 39 rotatably supported by the developing unit 20, and the urging force is transmitted to the developing unit 20 via a pressurizing spring 42. Then, the developing unit 20 received the urging force rotates in the Y1 direction centering on the connecting shaft 41 (the rotation axis line X1) with respect to the photosensitive member unit 30 as illustrated in FIG. 4, and the developing roller 22 abuts against the photosensitive drum 2. Accordingly, a toner image can be formed on the photosensitive drum 2. When image forming is complete, the pressing lever 40 is released from urging in the direction of the arrow B, and the developing roller 22 and the photosensitive drum 2 can be shifted from the abutting state to the separated state.

(Attachment and Detachment of Other Cartridge to Image Forming Apparatus)

According to the above-described exemplary embodiment, the image forming apparatus 1 is described which can attach and detach the first cartridge group 5 constituted of the process cartridge 90 and the toner cartridge 70 to and from the apparatus main body LA. However, the image forming apparatus is expected to be able to easily change a form of a cartridge. Therefore, an image forming apparatus is described below which can change a configuration so as to be detachably attachable a different cartridge while maintaining a part related to image forming in the apparatus main body 1A the same.

The part related to image forming means arrangement of the transfer roller 10 to the photosensitive drum 2 and arrangement of the exposure unit to the photosensitive drum 2. The drive side first guide 1A1 and a drive side second guide 201A1 are different from the above-described configuration, and the other configurations are the same. In the below description, parts in common with the above-described exemplary embodiment are denoted by the same reference numerals, and descriptions thereof are omitted.

(Configuration of Second Cartridge Group)

Figure 9:
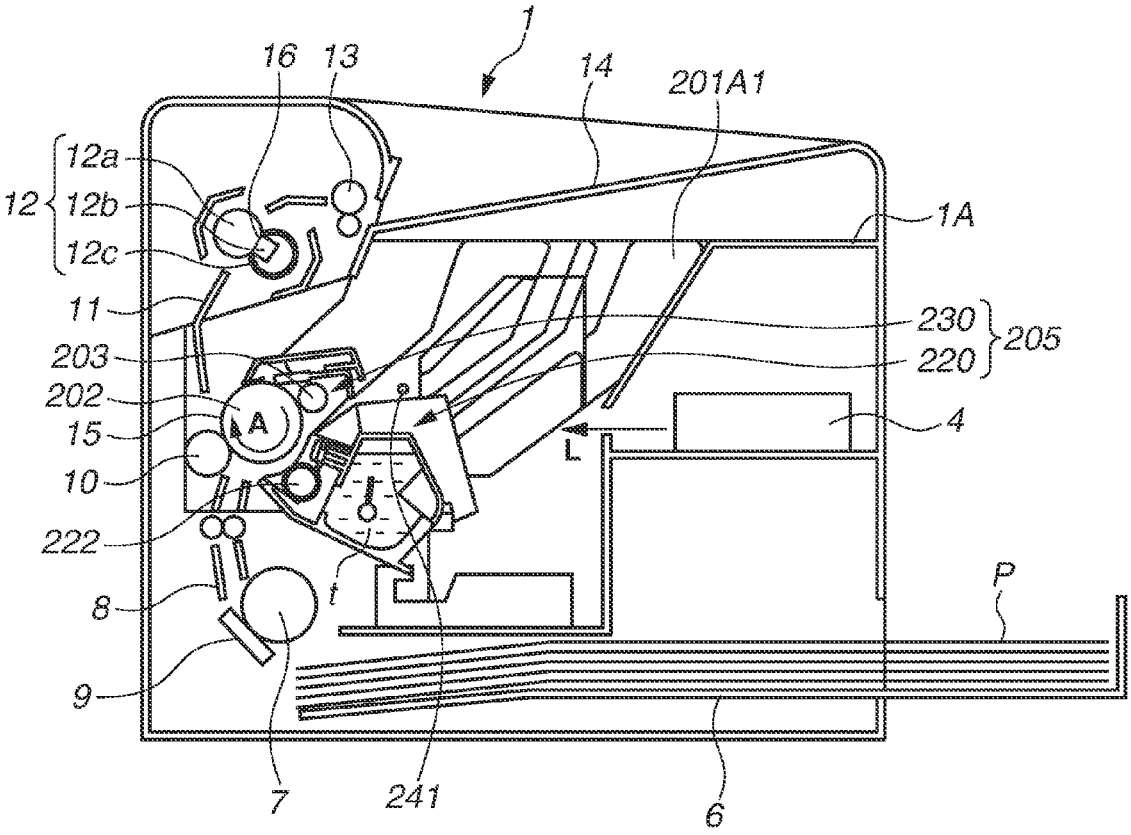
FIG. 9 is a cross-sectional view of the image forming apparatus to which the second cartridge group according to the exemplary embodiment is mounted.

The image forming apparatus 1 is described below which can attach and detach, to and from the apparatus main body 1A, a second cartridge group 205 constituted of a drum cartridge 230 and a developing cartridge 220 which is configured as a separate body from the drum cartridge 230. FIG. 9 illustrates the image forming apparatus 1 in which the second cartridge group 205 constituted of the drum cartridge 230 and the developing cartridge 220 is mounted to the apparatus main body 1A.

Figure 10:
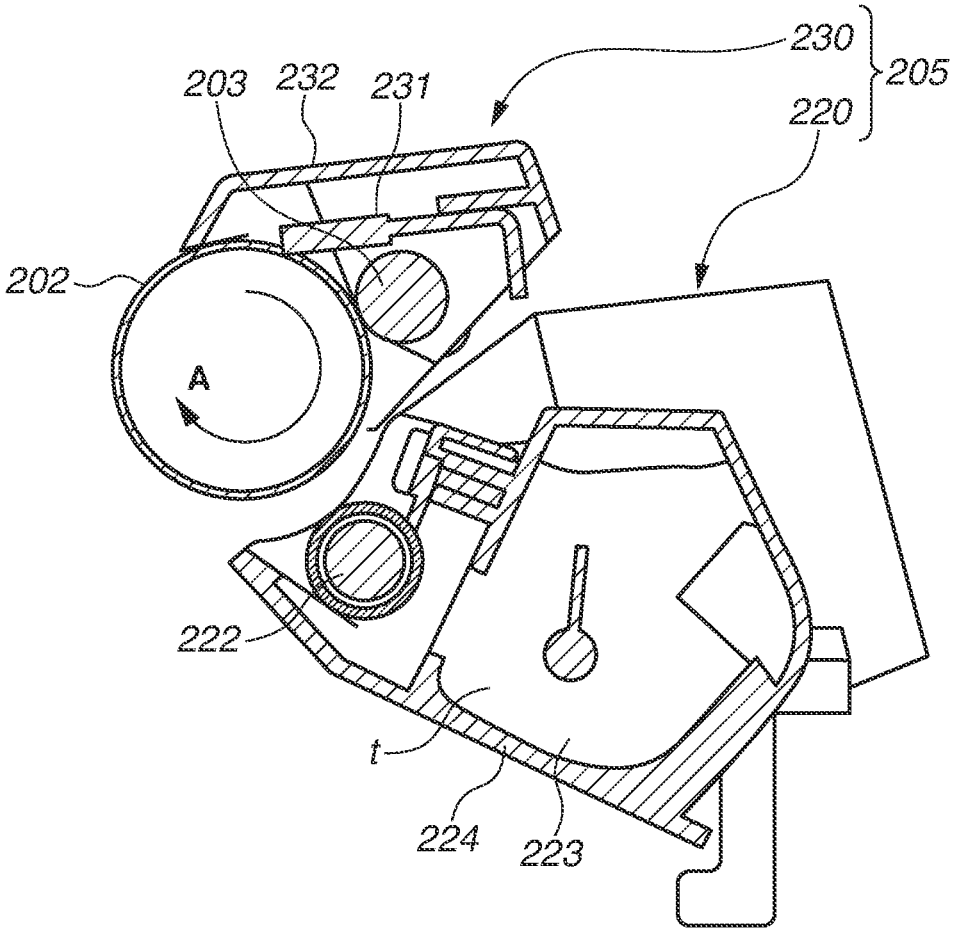
FIG. 10 is a cross-sectional view of the second cartridge group according to the exemplary embodiment.
Figure 11:
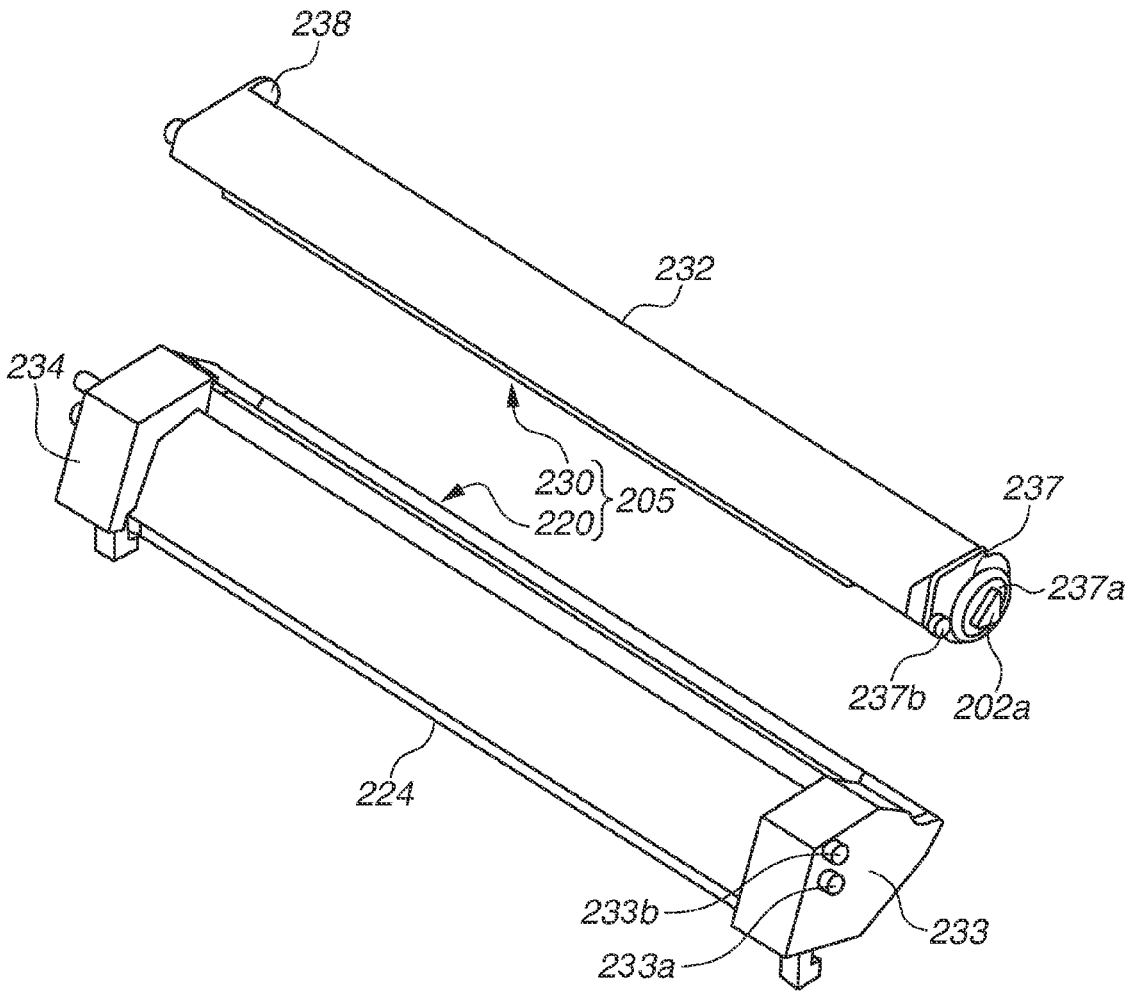
FIG. 11 is an exploded perspective view of the second cartridge group according to the exemplary embodiment.

First, the second cartridge group 205 is described with reference to FIGS. 10 and 11. FIG. 10 is a schematic cross-sectional view of a configuration of the second cartridge group 205. FIG. 11 illustrates the drum cartridge 230 and the developing cartridge 220 of the second cartridge group 205. As illustrated in FIG. 10, the second cartridge group 205 includes the drum cartridge 230 and the developing cartridge 220. The drum cartridge 230 and the developing cartridge 220 are separated from each other and respectively detachably attachable to the apparatus main body 1A. The developing cartridge 220 including a developing roller 222 is swingably attached to the drum cartridge 230 including a photosensitive drum 202.

The drum cartridge 230 includes a cleaning frame 232, the photosensitive drum 202 (see FIG. 10), a drive side drum bearing 237, a non-drive side drum bearing 238, a charging roller 203, and a cleaning unit 231. The photosensitive drum 202 is rotatably attached to the cleaning frame 232 via the drive side drum bearing 237 and the non-drive side drum bearing 238. A drive input unit 202*a* disposed on one end of the photosensitive drum 202 in the longitudinal direction engages with the drive output unit (not illustrated) of the apparatus main body 1A and receives a driving force from the drive motor (not illustrated) of the apparatus main body 1A. Accordingly, the photosensitive drum 202 is driven to rotate to the direction of the arrow A in response to an image forming operation (see FIG. 10).

The developing cartridge 220 includes a developing frame 224, the developing roller 222, a drive side developing bearing 233, a non-drive side developing bearing 234, and a toner chamber 223 for storing the toner t as illustrated in FIGS. 10 and 11. The developing roller 222 is rotatably attached to the developing frame 224 via the drive side developing bearing 233 and the non-drive side developing bearing 234.

(Configuration of Guiding Unit)

Figure 12:
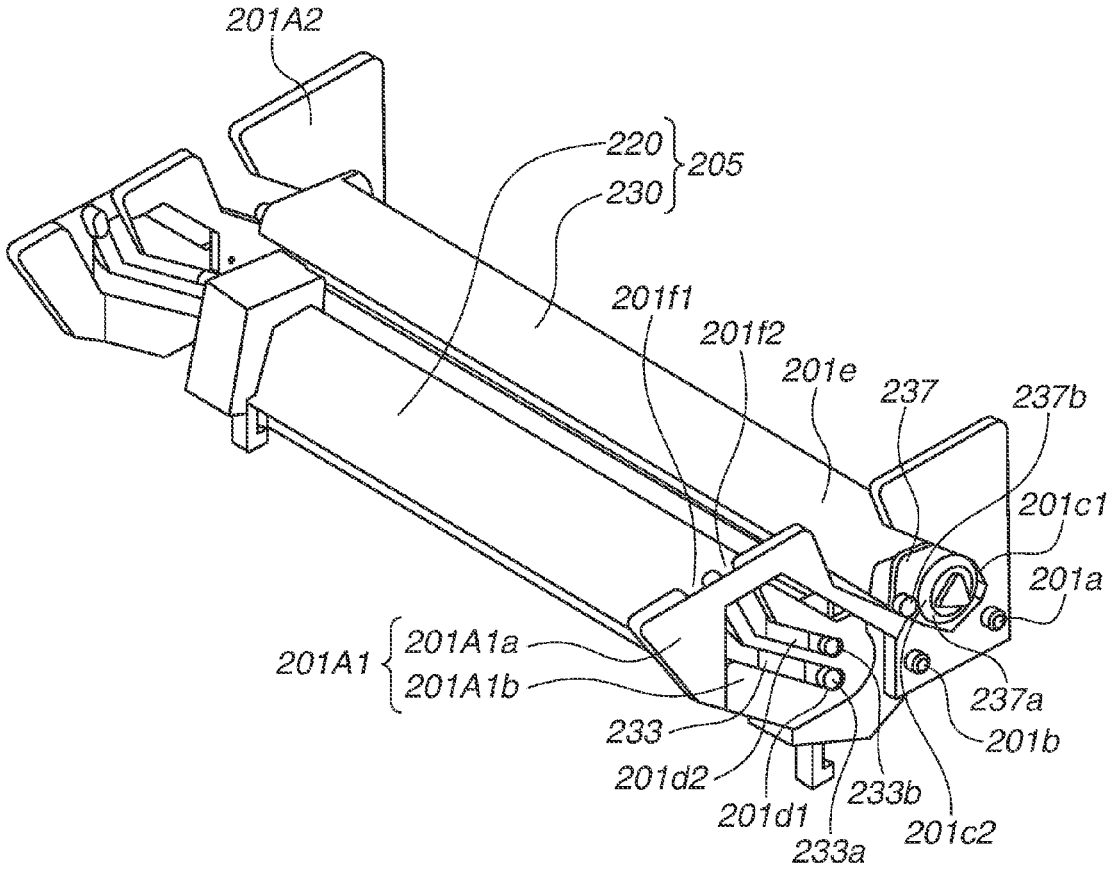
FIG. 12 is a perspective view of a second guide and the second cartridge group according to the exemplary embodiment.
Figure 13:
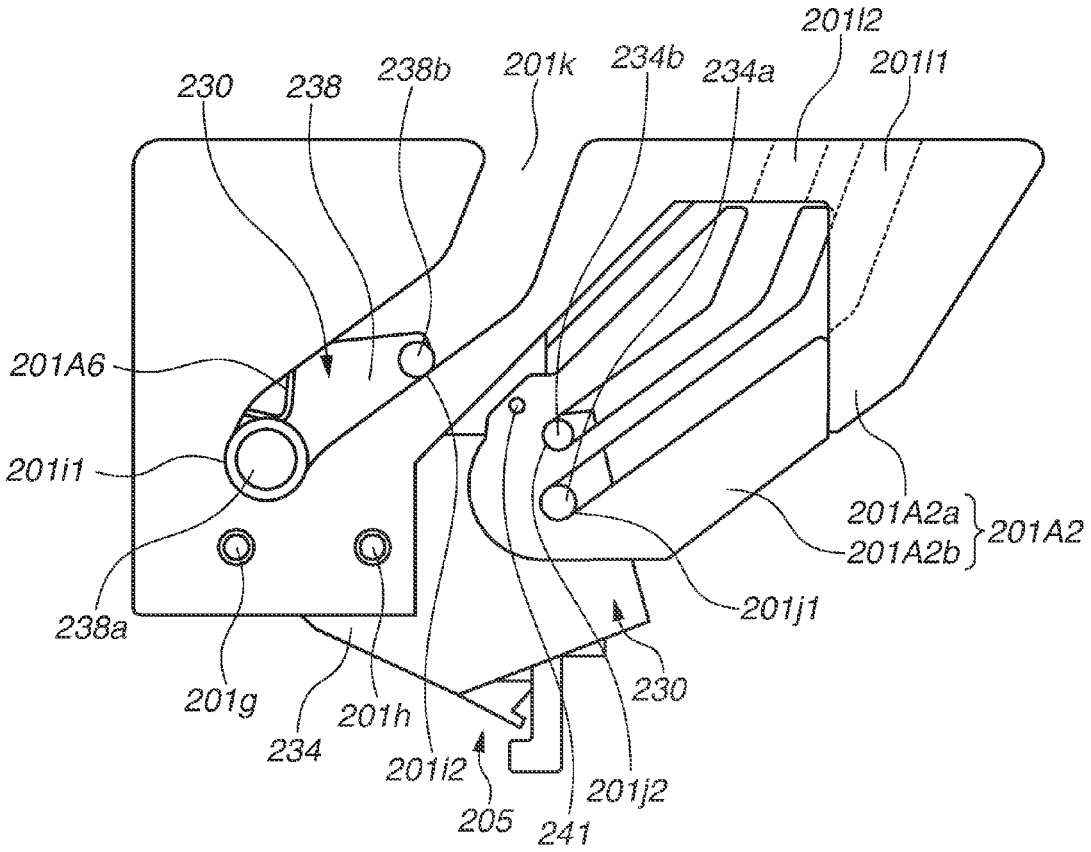
FIG. 13 is a side view of the second guide and the second cartridge group according to the exemplary embodiment.
Figure 14:
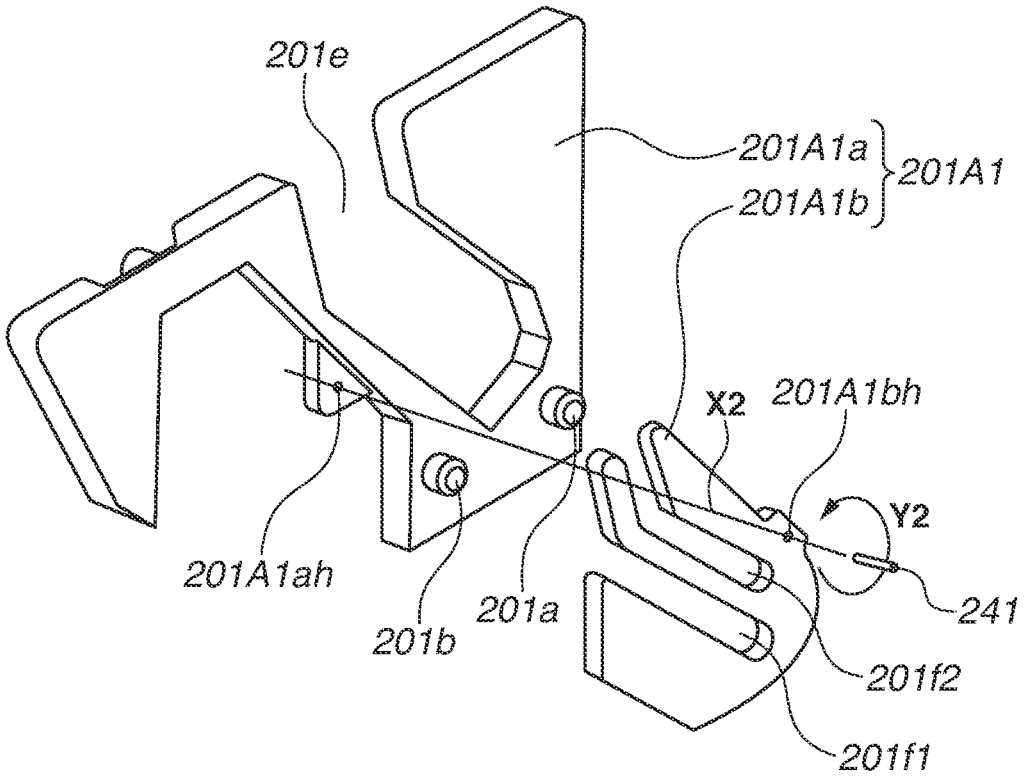
FIG. 14 is a perspective view of the second guide according to the exemplary embodiment.

Next, the configuration of the guiding unit when the second cartridge group 205 is attached to and detached from the apparatus main body 1A is described with reference to FIGS. 12, 13, and 14. FIG. 12 is a perspective view of a state in which the second cartridge group 205 is guided by the drive side second guide 201A1 and a non-drive side second guide 201A2 and mounted to the apparatus main body 1A. FIG. 13 is a side view of the second cartridge group 205 and the non-drive side second guide 201A2 in a state in which the second cartridge group 205 is mounted to the apparatus main body 1A. FIG. 14 is an exploded view of the drive side second guide 201A1.

As illustrated in FIGS. 12 and 13, the guiding unit (the second guide) fixed to the apparatus main body 1A is constituted of the drive side second guide 201A1 and the non-drive side second guide 201A2. When the second cartridge group 205 is mounted to the apparatus main body 1A, the drive side second guide 201A1 is disposed so as to face the drive side drum bearing 237 and the drive side developing bearing 233. Similarly, the non-drive side second guide 201A2 is disposed so as to face the non-drive side drum bearing 238 and the non-drive side developing bearing 234.

The drive side second guide 201A1 is provided with a positioned portion 201*a* and a rotation regulated portion 201*b* which have protruded boss shapes and a drum guiding portion 201*e* and developing guiding portions 201*f*1 and 201*f*2 which have groove shapes (FIG. 12). On the other hand, on the drive side, the drive side side plate 1A4 of the apparatus main body 1A is provided with the positioning portion 1A4*a* and the rotation regulating portion 1A4*b* which have concave shapes, such as holes, as illustrated in FIG. 7A. The positioned portion 201*a* engages with the positioning portion 1A4*a*, and the rotation regulated portion 201*b* engages with the rotation regulating portion 1A4*b*, so that the drive side second guide 201A1 is supported by and fixed to the apparatus main body 1A.

The drive side second guide 201A1 fixed to the apparatus main body 1A is configured to guide the drum cartridge 230 and the developing cartridge 220 by the drum guiding portion 201*e* and the developing guiding portions 201*f*1 and 201*f*2 when these cartridges are mounted to the apparatus main body 1A. More specifically, the drive side drum bearing 237 is provided with a first guided portion 237*a* (the positioning portion) and a second guided portion 237*b* (the rotation regulating portion) which are formed so as to include the bearing portion of the photosensitive drum 202 and configured to engage with the drum guiding portion 201*e*. In addition, the drive side developing bearing 233 is provided with a first developing guided portion 233*a* (an engagement portion) and a second developing guided portion 233*b* (the rotation regulating portion). The first developing guided portion 233*a* is configured to engage with the developing guiding portion 201*f*1, and the second developing guided portion 233*b* is configured to engage with the developing guiding portion 201*f*2. Accordingly, at the mounting position, a drive side drum positioning portion 201*c*1 for positioning the first guided portion 237*a* and a drive side drum rotation regulating portion 201*c*2 for regulating the rotation of the second guided portion 237*b* regulate movement of the drum cartridge 230. Further, at the mounting position, a drive side developing positioning portion 201*d*1 for positioning the first developing guided portion 233*a* and a drive side developing rotation regulating portion 201*d*2 for regulating the rotation of the second developing guided portion 233*b* regulate movement of the developing cartridge 220.

The drive side second guide 201A1 is constituted of a fixed guide 201A1*a* and a movable guide 201A1*b* as illustrated in FIG. 14. The fixed guide 201A1*a* is provided with a supporting hole 201A1*ah*, the movable guide 201A1*b* is provided with a supporting hole 201A1*bh*, and a rotation shaft 241 is inserted into the supporting hole 201A1*ah* and the supporting hole 201A1*bh*. Accordingly, the movable guide 201A1*b* is supported to be rotatable in a Y2 direction centering on a rotation axis line X2 with respect to the fixed guide 201A1*a*. The fixed guide 201A1*a* is provided with the positioned portion 201*a* and the rotation regulated portion 201*b* in addition to the drum guiding portion 201*e*, and the movable guide 201A1*b* is provided with the developing guiding portions 201*f*1 and 201*f*2. Thus, the positioned portion 201*a* engages with the positioning portion 1A4*a*, and the rotation regulated portion 201*b* engages with the rotation regulating portion 1A4*b*, so that the fixed guide 201A1*a* is supported by and fixed to the apparatus main body 1A. Accordingly, the movable guide 201A1*b* is configured to be movable with respect to the fixed guide 201A1*a*, and positions of the developing guiding portions 201*f*1 and 201*f*2 can be changed without changing a position of the drum guiding portion 201*e*.

Similar to the drive side second guide 201A1, the non-drive side second guide 201A2 is provided with a positioned portion 201*g* and a rotation regulated portion 201*h* which have protruded boss shapes and a drum guiding portion 201*k* and developing guiding portions 201*l*1 and 201*l*2 which have groove shapes (FIG. 13). On the other hand, on the non-drive side, the non-drive side side plate 1A5 of the apparatus main body 1A is provided with the positioning portion 1A5*a* and the rotation regulating portion 1A5*b* which have concave shapes, such as holes, as illustrated in FIG. 7B. The positioned portion 201*g* engages with the positioning portion 1A5*a*, and the rotation regulated portion 201*h* engages with the rotation regulating portion 1A5*b*, so that the non-drive side second guide 201A2 is supported by and fixed to the apparatus main body 1A.

The non-drive side second guide 201A2 fixed to the apparatus main body 1A is configured to guide the drum cartridge 230 and the developing cartridge 220 by the drum guiding portion 201*k* and the developing guiding portions 201*l*1 and 201*l*2 when these cartridges are mounted to the apparatus main body 1A. More specifically, the non-drive side drum bearing 238 is provided with a third guided portion 238*a* (the positioning portion) and a fourth guided portion 238*b* (the rotation regulating portion) which are formed so as to include the bearing portion of the photosensitive drum 202 and configured to engage with the drum guiding portion 201*k*. In addition, the non-drive side developing bearing 234 is provided with a third developing guided portion 234*a* (the engagement portion) and a fourth developing guided portion 234*b* (the rotation regulating portion). The third developing guided portion 234*a* is configured to engage with the developing guiding portion 201*l*1, and the fourth developing guided portion 234*b* is configured to engage with the developing guiding portion 201*l*2. A spring 201A6 urges the third guided portion 238*a* toward a non-drive side drum positioning portion 201*i*1 and urges the fourth guided portion 238*b* toward a non-drive side drum rotation regulating portion 201*i*2 so as to regulate the movement of the drum cartridge 230 from the mounting position. Similarly, the spring, not illustrated, urges the third developing guided portion 234*a* toward a non-drive side developing positioning portion 201*j*1 and urges the fourth developing guided portion 234*b* toward a drive side developing rotation regulating portion 201*j*2 so as to regulate the movement of the developing cartridge 220 from the mounting position.

The non-drive side second guide 201A2 is also constituted of a fixed guide 201A2*a* and a movable guide 201A2*b*. Similar to the drive side second guide 201A1, the fixed guide 201A2*a* and the movable guide 201A2*b* are supported to be rotatable in the Y2 direction centering on the rotation axis line X2. The fixed guide 201A2*a* is provided with the positioned portion 201*g* and the rotation regulated portion 201*h* in addition to the drum guiding portion 201*k*, and the movable guide 201A2*b* is provided with the developing guiding portions 201*l*1 and 201*l*2. Thus, the positioned portion 201*g* engages with the positioning portion 1A5*a*, and the rotation regulated portion 201*h* engages with the rotation regulating portion 1A5*b*, so that the fixed guide 201A2*a* is supported by and fixed to the apparatus main body 1A. Accordingly, the movable guide 201A2*b* is configured to be movable with respect to the fixed guide 201A2*a*, and positions of the developing guiding portions 201/1 and 201/2 can be changed without changing a position of the drum guiding portion 201*k*.

(Abutment and Separation Method)

Figure 15A:
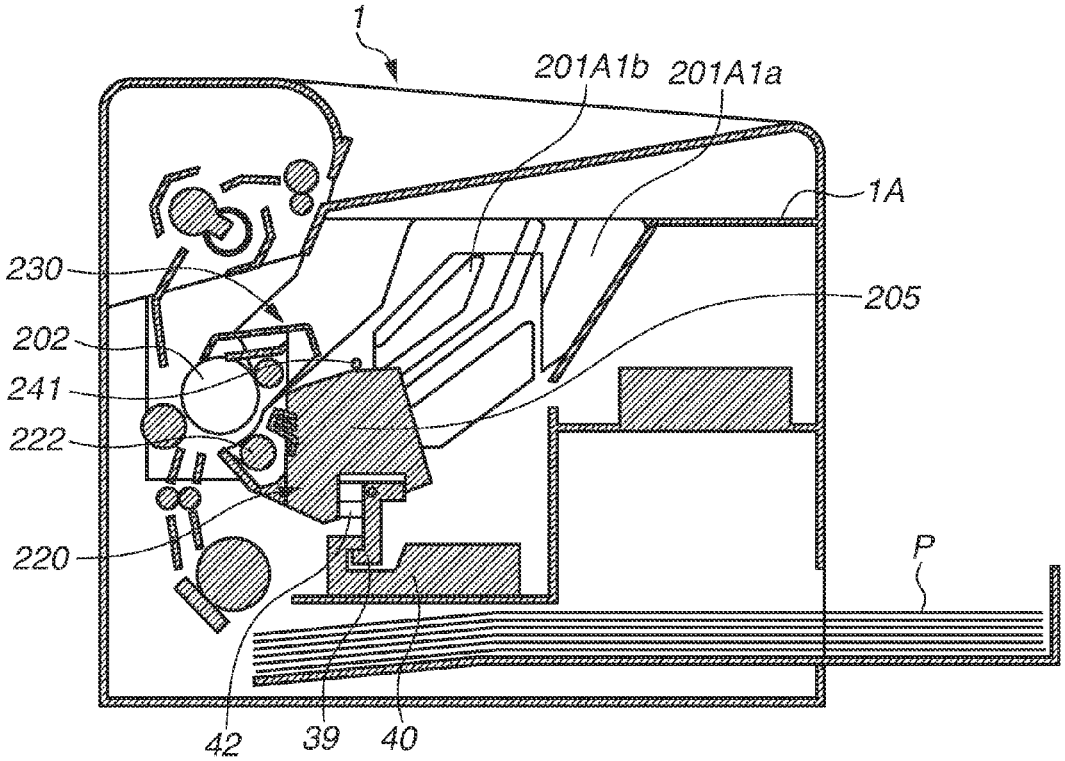
FIGS. 15A and 15B are cross-sectional views of an image forming apparatus to which a third cartridge group according to a first modification is mounted.
Figure 15B:
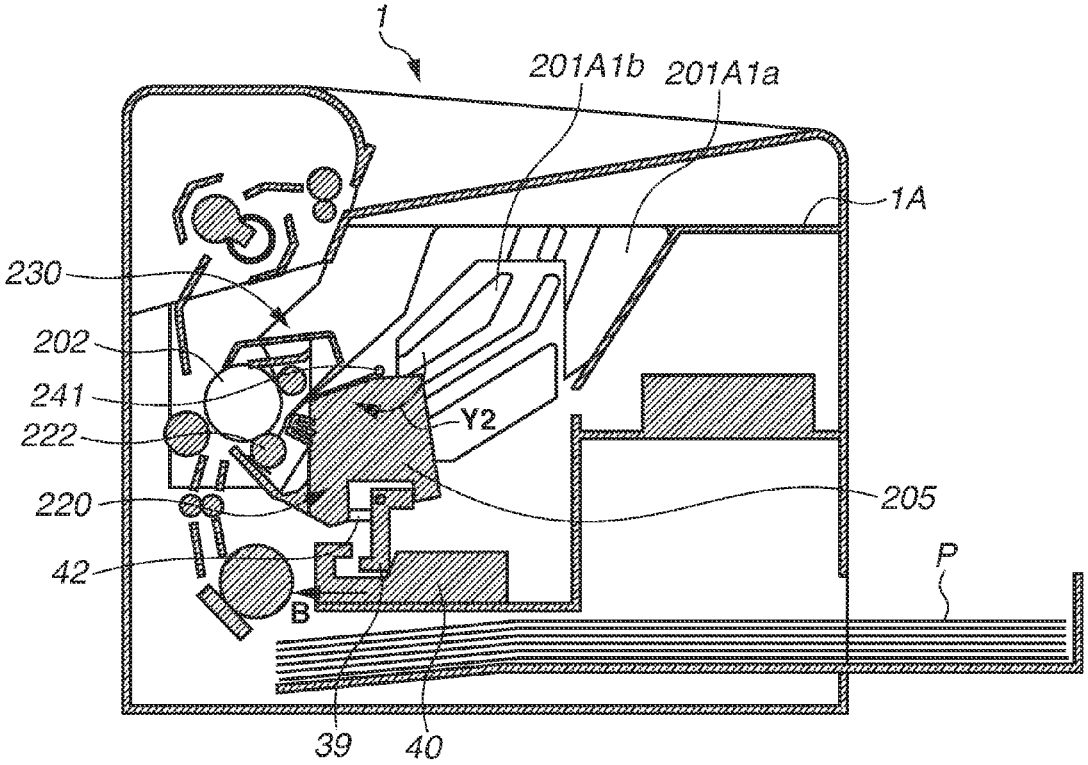

Next, abutment and separation of the photosensitive drum 202 and the developing roller 222 of the second cartridge group 205 is described. In the image forming apparatus 1, the photosensitive drum 202 and the developing roller 222 abut with each other only when an image is transferred to the recording medium P, and other than that, the photosensitive drum 202 and the developing roller 222 are separated from each other. The abutment and separation method is described with reference to FIGS. 15A and 15B. FIGS. 15A and 15B are cross-sectional views of the apparatus main body 1A to which the second cartridge group 205 is mounted. FIG. 15A illustrates a state in which the developing roller 222 is separated from the photosensitive drum 202. FIG. 15B illustrates a state in which the developing roller 222 abuts against the photosensitive drum 202 in image forming.

As illustrated in FIG. 15A, the developing cartridge 220 and the drum cartridge 230 are in a state being respectively mounted to the movable guide 201A1*b* and the fixed guide 201A1*a*, and the developing roller 222 and the photosensitive drum 202 are in a separated state. When a job signal is input to the apparatus main body 1A in the separated state, the pressing lever 40 of the apparatus main body 1A is urged to the direction of the arrow B (FIG. 15B). The pressing lever 40 urges the pressed member 39 rotatably supported by the developing cartridge 220, and the urging force is transmitted to the developing cartridge 220 via the pressurizing spring 42. Then, the developing cartridge 220 received the urging force rotates in the Y2 direction centering on the movable guide rotation shaft 241 (the rotation axis line X2) together with the movable guide 201A1*b*, and the developing roller 222 abuts against the photosensitive drum 202. Accordingly, a toner image can be formed on the photosensitive drum 202. Similar to the above description, when image forming is complete, the pressing lever 40 is released from urging in the direction of the arrow B, and the developing roller 222 and the photosensitive drum 202 can be shifted from the abutting state to the separated state.

(Effect)

As described above, a guide corresponding to a cartridge can be mounted to the apparatus main body 1A, and thus the configuration of the image forming apparatus can be changed so as to be able to selectively attach and detach a different cartridge while maintaining a part related to image forming the same. Accordingly, a form of a cartridge can be easily changed without changing a design of the part related to image forming to make, for example, consumables according to a sales area and a purpose of use available.

More specifically, in the process cartridge 90, the first guided portion 37*a* and the third guided portion 38*a* to be the positioning portions are formed so as to include the bearing portion of the photosensitive drum 2, and the second guided portion 37*b* and the fourth guided portion 38*b* are disposed on different places as the rotation regulating portions. Similarly, in the drum cartridge 230, the first guided portion 237*a* and the third guided portion 238*a* to be the positioning portions are formed so as to include the bearing portion of the photosensitive drum 202, and the second guided portion 237*b* and the fourth guided portion 238*b* are disposed on different places as the rotation regulating portions. Further, the rotation axis line X1 of the developing unit 20 to the photosensitive member unit 30 is disposed on a same line as the rotation axis line X2 of the movable guide 201A1*b* to the fixed guide 201A1*a*. Accordingly, abutment and separation of the photosensitive drum and the developing roller can be performed regardless of a cartridge form.

In other words, a guided portion to be a positioning portion is disposed near the bearing portion of the photosensitive drum, and the guided portion is positioned and fixed to the apparatus main body. On the other hand, the rotation axis lines for abutting and separating the photosensitive drum and the developing roller are disposed on a same line between the cartridges, between the guiding units, or between the cartridge and the guiding portion, in other words, disposed on a certain place with respect to a rotation center of the photosensitive drum and a rotation center of the developing roller. Accordingly, if the form of the cartridge is changed, it is not necessary to change a mechanism related to the abutment and separation of the photosensitive drum and the developing roller according to the apparatus main body, and the form of the cartridge can be easily changed.

<First Modification>

(Configuration of Third Cartridge Group)

The image forming apparatus 1 is described above which can attach and detach the process cartridge 90 and the toner cartridge 70 or the drum cartridge 230 and the developing cartridge 220 to and from the apparatus main body 1A. However, forms of the process cartridges which are detachably attachable to the image forming apparatus 1 are not limited to the above-described forms.

Figure 16:
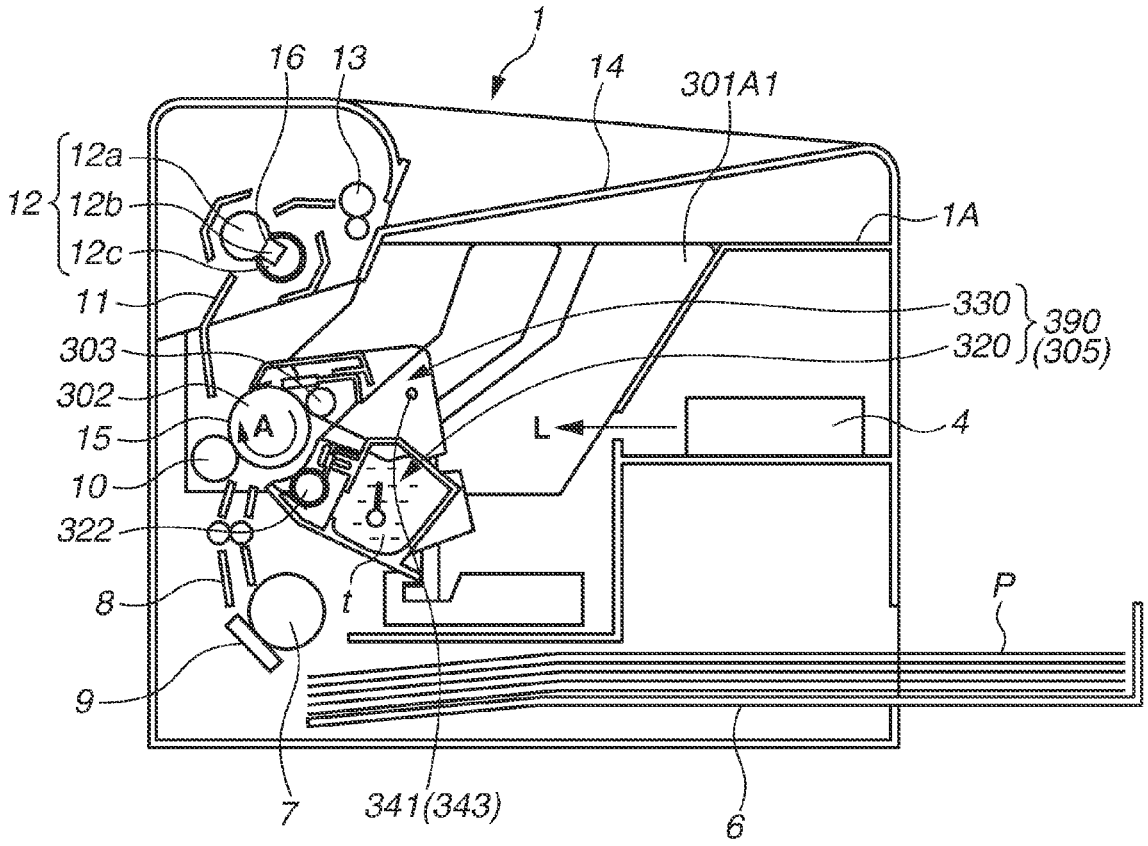
FIG. 16 is a cross-sectional view of the image forming apparatus to which the third cartridge group according to the first modification is mounted.

The image forming apparatus 1 is described below which can attach and detach a third cartridge group 305, namely a process cartridge 390, to and from the apparatus main body 1A. FIG. 16 illustrates the image forming apparatus 1 in which the process cartridge 390 is mounted to the apparatus main body 1A.

Figure 17:
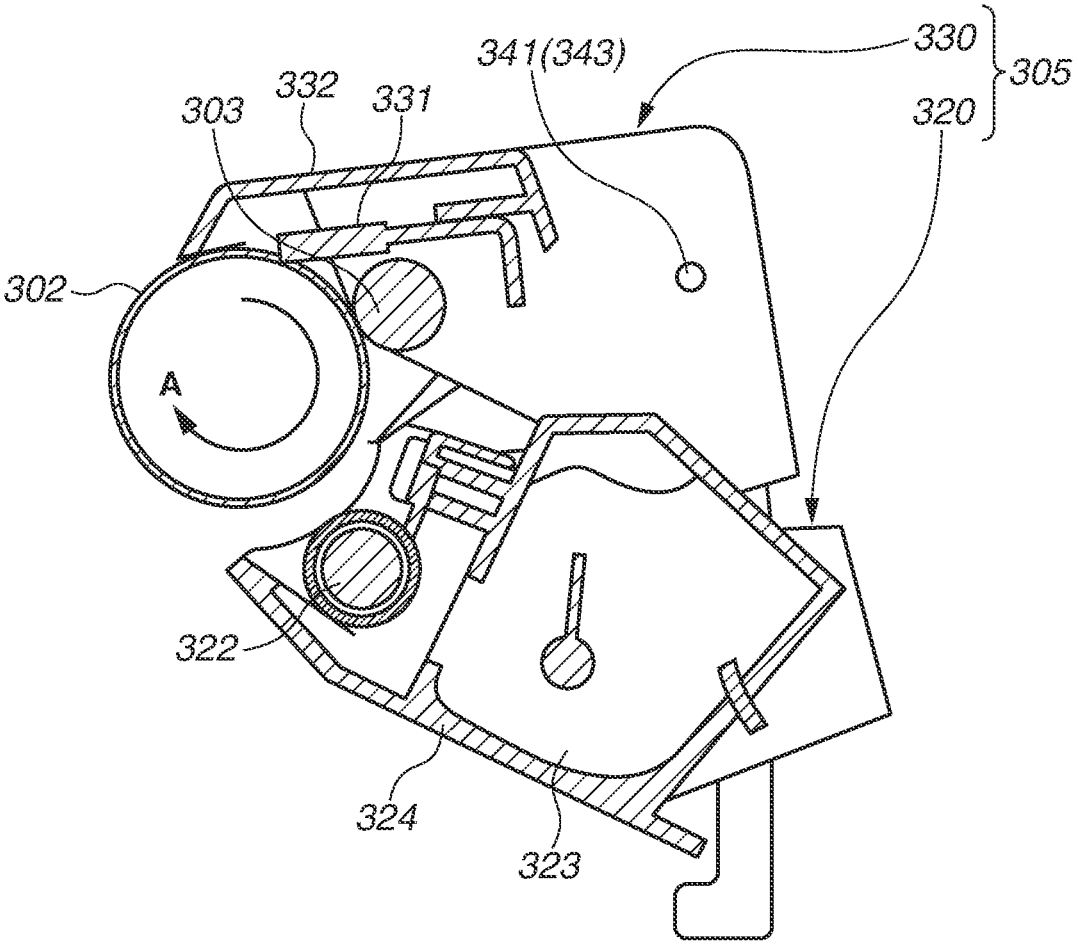
FIG. 17 is a cross-sectional view of the third cartridge group according to the first modification.
Figure 18:
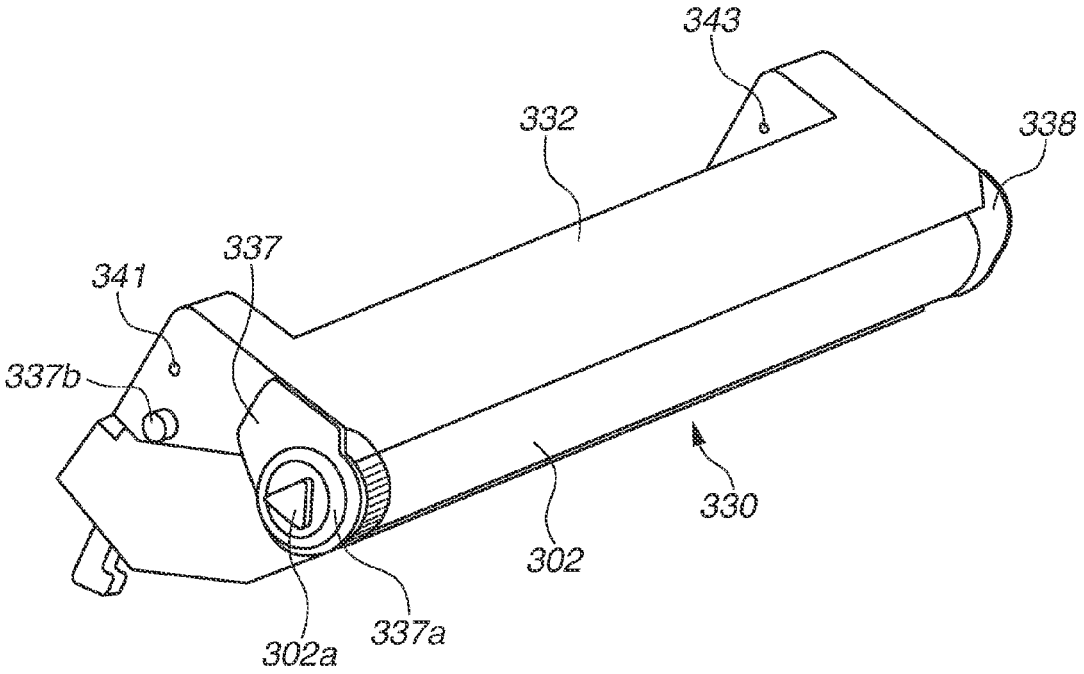
FIG. 18 is a perspective view of a part of the third cartridge group according to the first modification.
Figure 19:
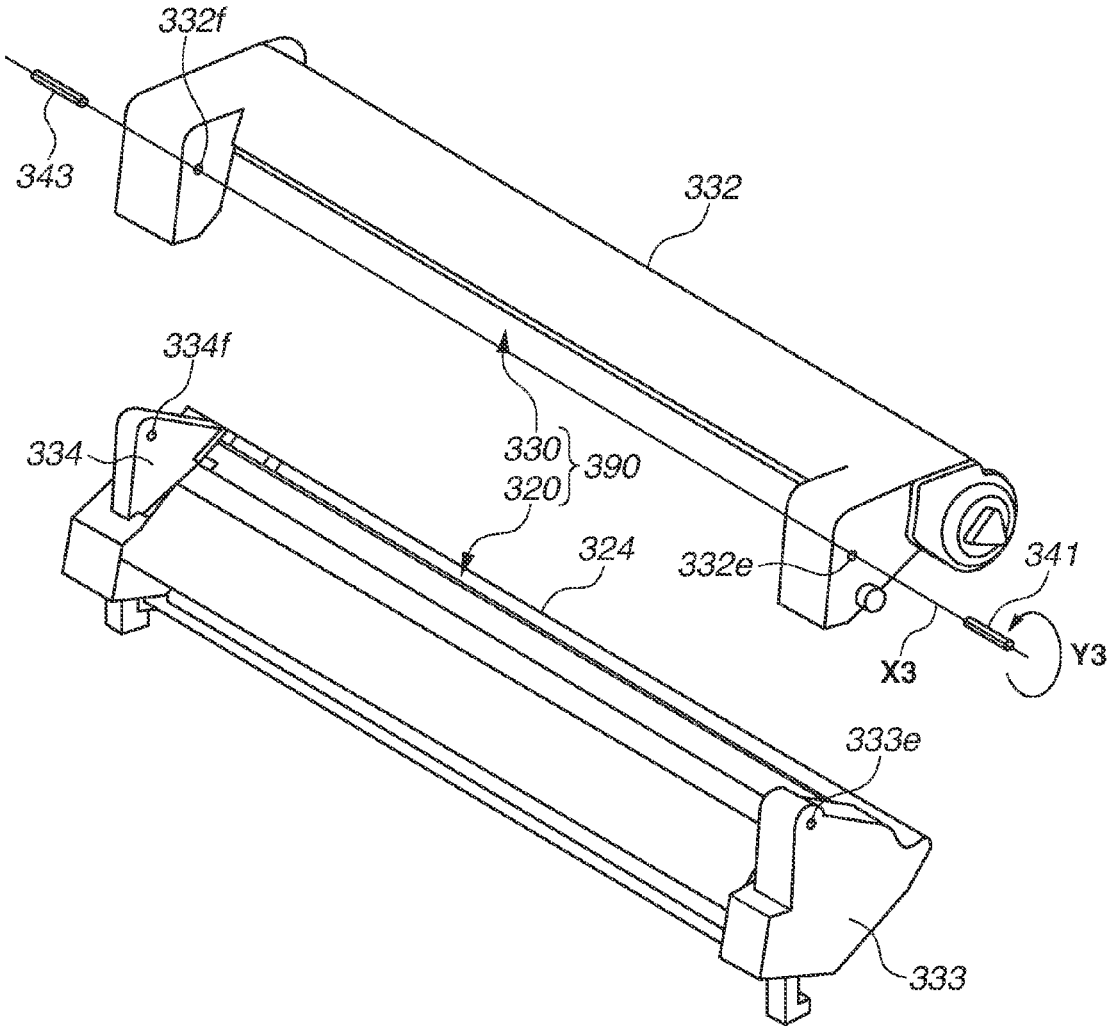
FIG. 19 is an exploded perspective view of the third cartridge group according to the first modification.

The third cartridge group 305 detachably attachable to the apparatus main body 1A of the image forming apparatus 1 is described with reference to FIGS. 17, 18, and 19. FIG. 17 is a schematic cross-sectional view of a configuration of the third cartridge group 305. FIG. 18 is a perspective view of the third cartridge group 305. FIG. 19 illustrates a state in which the process cartridge 390 is broken down into a photosensitive member unit 330 and a developing unit 320. As illustrated in FIG. 17, the third cartridge group 305 includes the process cartridge 390 in which the photosensitive member unit 330 and the developing unit 320 are unified. The process cartridge 390 is detachably attachable to the apparatus main body 1A. In the process cartridge 390, the developing unit 320 including a developing roller 322 is swingably attached to the photosensitive member unit 330 including a photosensitive drum 302.

The photosensitive member unit 330 includes a cleaning frame 332, the photosensitive drum 302, a drive side drum bearing 337, a non-drive side drum bearing 338, a charging roller 303, and a cleaning unit 331. The photosensitive drum 302 is rotatably attached to the cleaning frame 332 via the drive side drum bearing 337 and the non-drive side drum bearing 338. A drive input unit 302*a* disposed on one end of the photosensitive drum 302 in the longitudinal direction engages with the drive output unit (not illustrated) of the apparatus main body 1A and receives a driving force from the drive motor (not illustrated) of the apparatus main body 1A. Accordingly, the photosensitive drum 302 is driven to rotate to the direction of the arrow A in response to an image forming operation (see FIG. 17).

The developing cartridge 320 includes a developing frame 324, the developing roller 322, a drive side developing bearing 333, a non-drive side developing bearing 334, and a toner chamber 323 for storing the toner t as illustrated in FIGS. 17 and 19. The developing roller 322 is rotatably attached to the developing frame 324 via the drive side developing bearing 333 and the non-drive side developing bearing 334.

As illustrated in FIG. 19, the developing unit 320 is supported by the photosensitive member unit 330. More specifically, the cleaning frame 332 of the photosensitive member unit 330 is provided with a supporting hole 332*e* and a supporting hole 332*f* so that openings of the holes exist on a straight line. In addition, end portions of the developing frame 324 of the developing unit 320 are respectively provided with the drive side developing bearing 333 and the non-drive side developing bearing 334, and a supporting hole 333*e* of the drive side developing bearing 333 and a supporting hole 334*f* of the non-drive side developing bearing 334 are provided so that openings of the holes exist on a straight line.

On the drive side of the process cartridge 390 in the longitudinal direction, a connecting shaft 341 is inserted into the supporting hole 332*e* of the cleaning frame 332 and the supporting hole 333*e* of the drive side developing bearing 333. On the non-drive side of the process cartridge 390 in the longitudinal direction, a connecting shaft 343 is inserted into the supporting hole 332*f* of the cleaning frame 332 and the supporting hole 334*f* of the non-drive side developing bearing 334. Accordingly, the developing unit 320 is rotatably supported in a Y3 direction with respect to the photosensitive member unit 330. This axis is defined as a rotation axis line X3 of the developing unit 320 with respect to the photosensitive member unit 330.

(Configuration of Guiding Unit)

Figure 20:
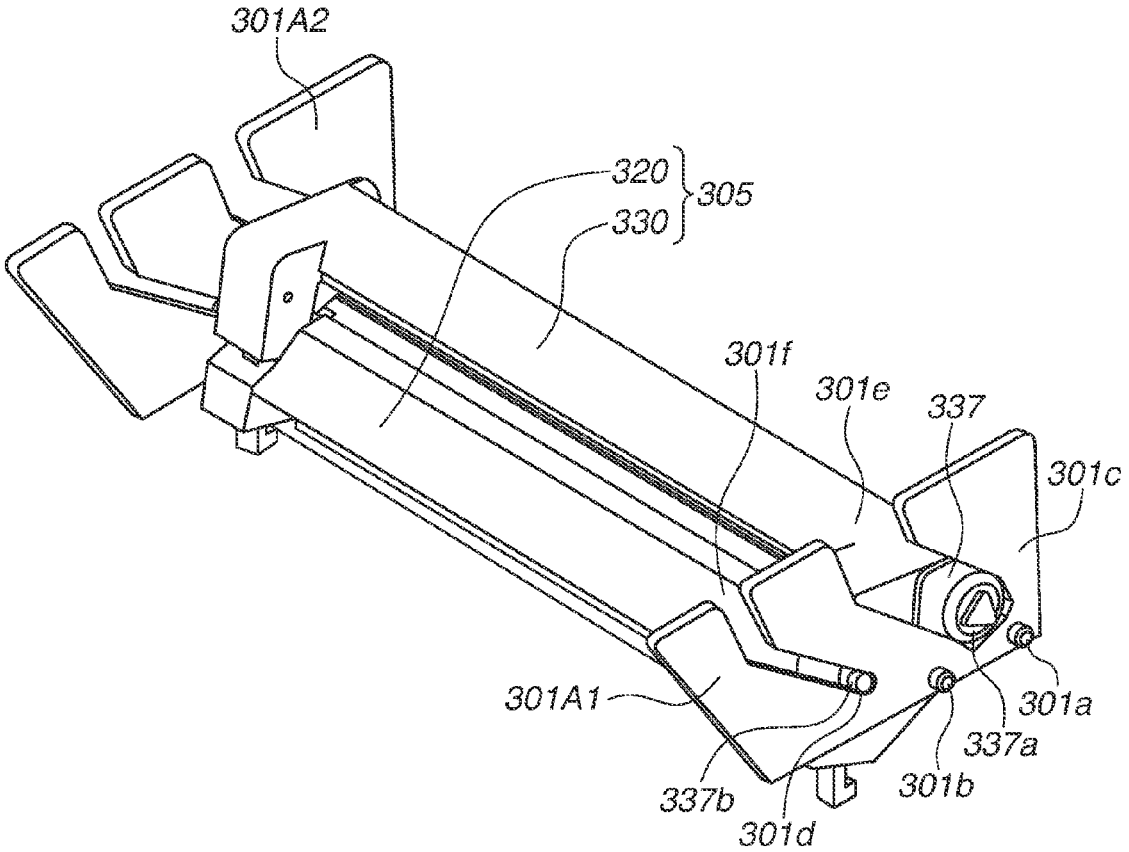
FIG. 20 is a perspective view of a third guide and the third cartridge group according to the first modification.
Figure 21:
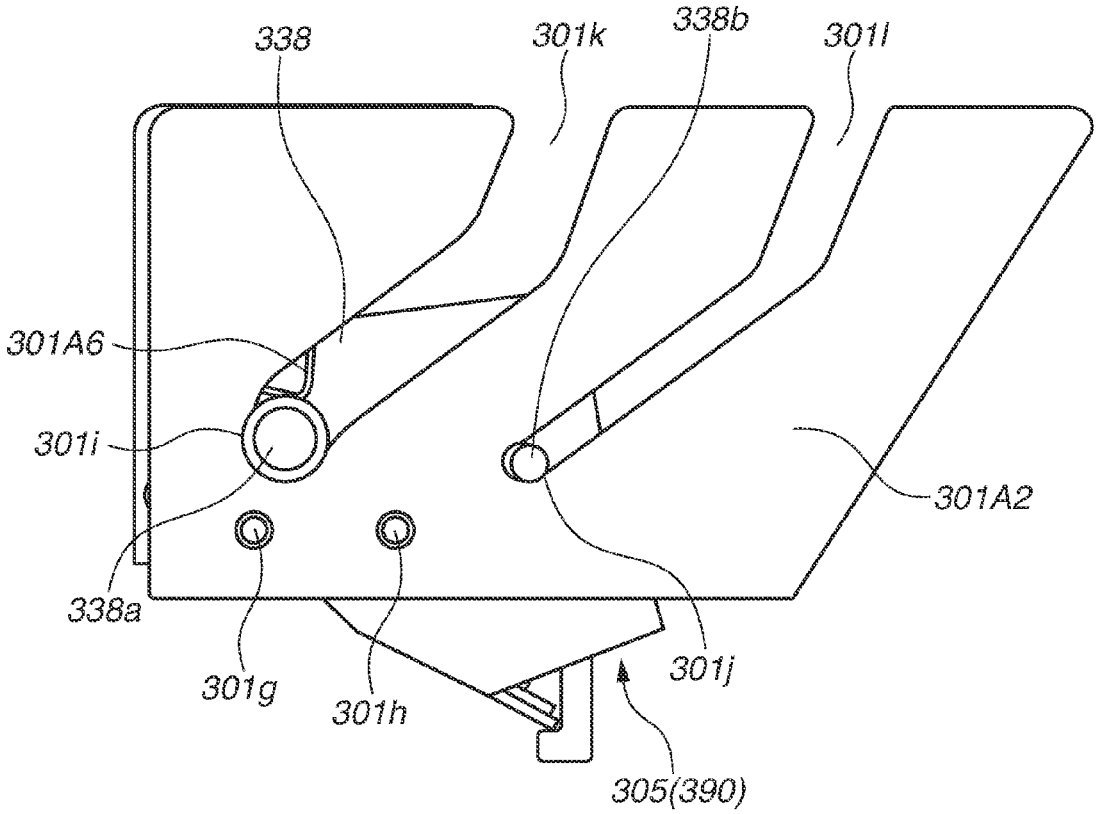
FIG. 21 is a side view of the third guide and the third cartridge group according to the first modification.

Next, the configuration of the guiding unit when the third cartridge group 305 is attached to and detached from the apparatus main body 1A is described with reference to FIGS. 20 and 21. FIG. 20 is a perspective view of a state in which the third cartridge group 305 is guided by a drive side third guide 301A1 and a non-drive side third guide 301A2 and mounted to the apparatus main body 1A. FIG. 21 is a side view of the third cartridge group 305 and the non-drive side third guide 301A2 in a state in which the third cartridge group 305 is mounted to the apparatus main body 1A.

As illustrated in FIGS. 20 and 21, the guiding unit (the third guide) fixed to the apparatus main body 1A is constituted of the drive side third guide 301A1 and the non-drive side third guide 301A2. When the third cartridge group 305 is mounted to the apparatus main body 1A, the drive side third guide 301A1 is disposed so as to face the drive side drum bearing 337. Similarly, the non-drive side third guide 301A2 is disposed so as to face the non-drive side drum bearing 338.

The drive side third guide 301A1 is formed by a plate member and provided with a positioned portion 301*a* and a rotation regulated portion 301*b* which have protruded boss shapes and a drum guiding portion 301*e* and a developing guiding portion 301*f* which have groove shapes (FIG. 20). On the other hand, on the drive side, the drive side side plate 1A4 of the apparatus main body 1A is provided with the positioning portion 1A4*a* and the rotation regulating portion 1A4*b* which have concave shapes, such as holes, as illustrated in FIG. 7A. The positioned portion 301*a* engages with the positioning portion 1A4*a*, and the rotation regulated portion 301*b* engages with the rotation regulating portion 1A4*b*, so that the drive side third guide 301A1 is supported by and fixed to the apparatus main body 1A.

The drive side third guide 301A1 fixed to the apparatus main body 1A is configured to guide the process cartridge 390 by the drum guiding portion 301*e* and the developing guiding portion 301*f* when the process cartridge 390 is mounted to the apparatus main body 1A. More specifically, the drive side drum bearing 337 is provided with a first guided portion 337*a* (the positioning portion) and a second guided portion 337*b* (the rotation regulating portion) which are formed so as to include a bearing portion of the photosensitive drum 302. In addition, the first guided portion 337*a* is configured to engage with the drum guiding portion 301*e*, and the second guided portion 337*b* is configured to engage with the developing guiding portion 301*f*. A spring, not illustrated, urges the first guided portion 337*a* toward a drive side positioning portion 301*c* and urges the second guided portion 337*b* toward a drive side rotation regulating portion 301*d* so as to regulate movement of the photosensitive member unit 330 from the mounting position.

Similar to the drive side third guide 301A1, the non-drive side third guide 301A2 is formed by a plate member and provided with a positioned portion 301*g* and a rotation regulated portion 301*h* which have protruded boss shapes and a drum guiding portion 301*k* and a developing guiding portion 301*l* which have groove shapes (FIG. 21). On the other hand, on the non-drive side, the non-drive side side plate 1A5 of the apparatus main body 1A is provided with the positioning portion 1A5*a* and the rotation regulating portion 1A5*b* which have concave shapes, such as holes, as illustrated in FIG. 7B. The positioned portion 301*g* engages with the positioning portion 1A5*a*, and the rotation regulated portion 301*h* engages with the rotation regulating portion 1A5*b*, so that the non-drive side third guide 301A2 is supported by and fixed to the apparatus main body 1A.

The non-drive side third guide 301A2 fixed to the apparatus main body 1A is configured to guide the process cartridge 390 by the drum guiding portion 301*k* and the developing guiding portion 301*l* when the process cartridge 390 is mounted to the apparatus main body 1A. More specifically, the non-drive side drum bearing 338 is provided with a third guided portion 338*a* (the positioning portion) and a fourth guided portion 338*b* (the rotation regulating portion) which are formed so as to include the bearing portion of the photosensitive drum 302. In addition, the third guided portion 338*a* is configured to engage with the drum guiding portion 301*k*, and the fourth guided portion 338*b* is configured to engage with the developing guiding portion 301*l*. The spring 301A6 urges the third guided portion 338*a* toward a non-drive side positioning portion 301*i* and urges the fourth guided portion 338*b* toward a non-drive side rotation regulating portion 301*j* so as to regulate the movement of the photosensitive member unit 330 from the mounting position.

As described above, the drive side third guide 301A1 and the non-drive side third guide 301A2 fixed to the apparatus main body 1A, the drive side drum bearing 337, and the non-drive side drum bearing 338 can guide the third cartridge group 305 to the mounting position of the apparatus main body 1A.

(Abutment and Separation Method)

Next, abutment and separation of the photosensitive drum 302 and the developing roller 322 of the third cartridge group 305 is described. The method is similar to the method for abutting the photosensitive drum 2 against the developing roller 22 in the first cartridge group 5. More specifically, when a job signal is input to the apparatus main body 1A, the pressing lever 40 of the apparatus main body 1A is urged to the direction of the arrow B. The pressing lever 40 urges the pressed member rotatably supported by the developing unit 320, the developing unit 320 rotates in the Y3 direction centering on the connecting shaft 341 (the rotation axis line X3) with respect to the photosensitive member unit 330, and the developing roller 322 abuts against the photosensitive drum 302. Accordingly, a toner image can be formed on the photosensitive drum 302. Similar to the above description, when image forming is complete, the pressing lever 40 is released from urging in the direction of the arrow B, and the developing roller 322 and the photosensitive drum 302 can be shifted from the abutting state to the separated state.

As described above, in the photosensitive member unit 330, the first guided portion 337*a* and the third guided portion 338*a* to be the positioning portions are formed so as to include the bearing portion of the photosensitive drum 302, and the second guided portion 337*b* and the fourth guided portion 338*b* are disposed on different places as the rotation regulating portions. Further, the rotation axis line X3 of the developing unit 320 to the photosensitive member unit 330 is disposed on a same line as the rotation axis line X1 of the developing unit 20 to the photosensitive member unit 30 of the first cartridge group 5. Accordingly, the third cartridge group 305 is detachably attachable to the apparatus main body 1A, and the abutment and separation of the developing roller 322 and the photosensitive drum 302 can be performed. As described above, the image forming apparatus is provided which can change a configuration so as to be detachably attachable a different cartridge by only changing the guiding unit while maintaining a part related to image forming the same. Further, when the configuration of the third cartridge group 305 is adopted, it is not necessary to change the mechanism related to the abutment and separation of the photosensitive drum and the developing roller according to the apparatus main body, and the form of the cartridge can be easily changed.

<Second Modification>

(Configuration of Fourth Cartridge Group)

Forms of the process cartridges detachably attachable to the image forming apparatus 1 are not limited to the first cartridge group 5, the second cartridge group 205, and the third cartridge group 305 described above.

Figure 22:
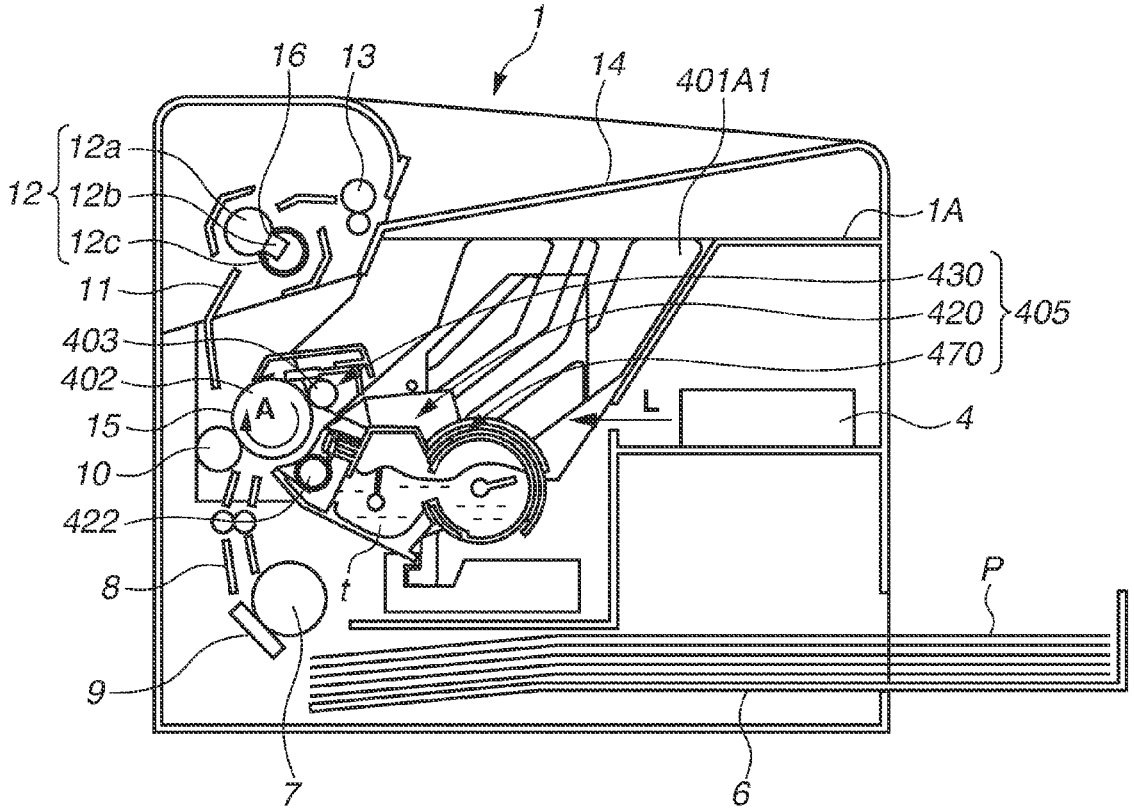
FIG. 22 is a cross-sectional view of an image forming apparatus to which a fourth cartridge group according to a second modification is mounted.

The image forming apparatus 1 is described below which can attach and detach, to and from the apparatus main body 1A, a fourth cartridge group 405 constituted of a drum cartridge 430, a developing cartridge 420, and a toner cartridge 470. FIG. 22 illustrates the image forming apparatus 1 in which the fourth cartridge group 405 is mounted to the apparatus main body 1A.

Figure 23:
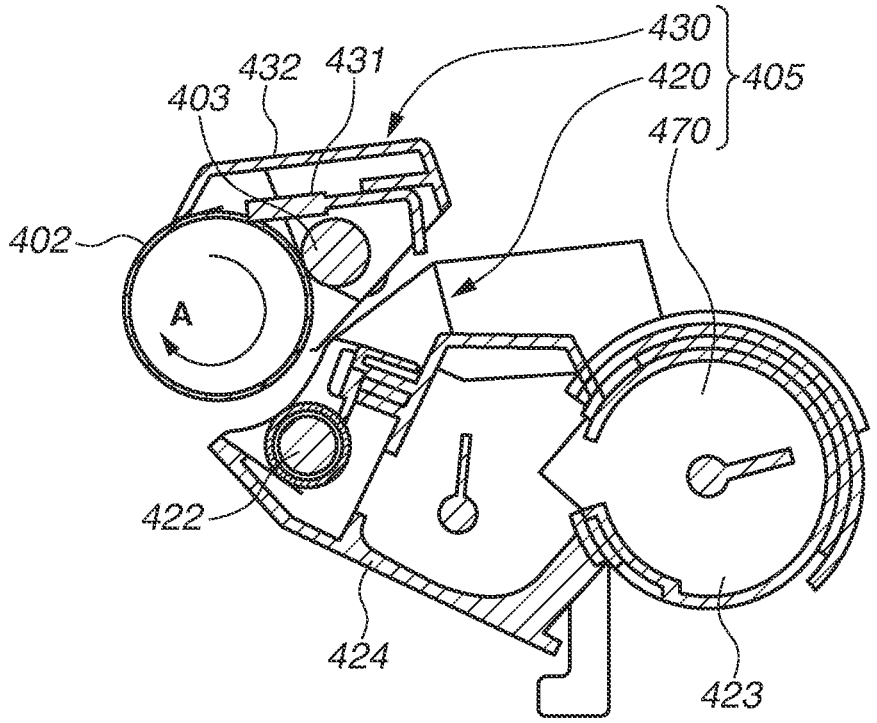
FIG. 23 is a cross-sectional view of the fourth cartridge group according to the second modification.
Figure 24:
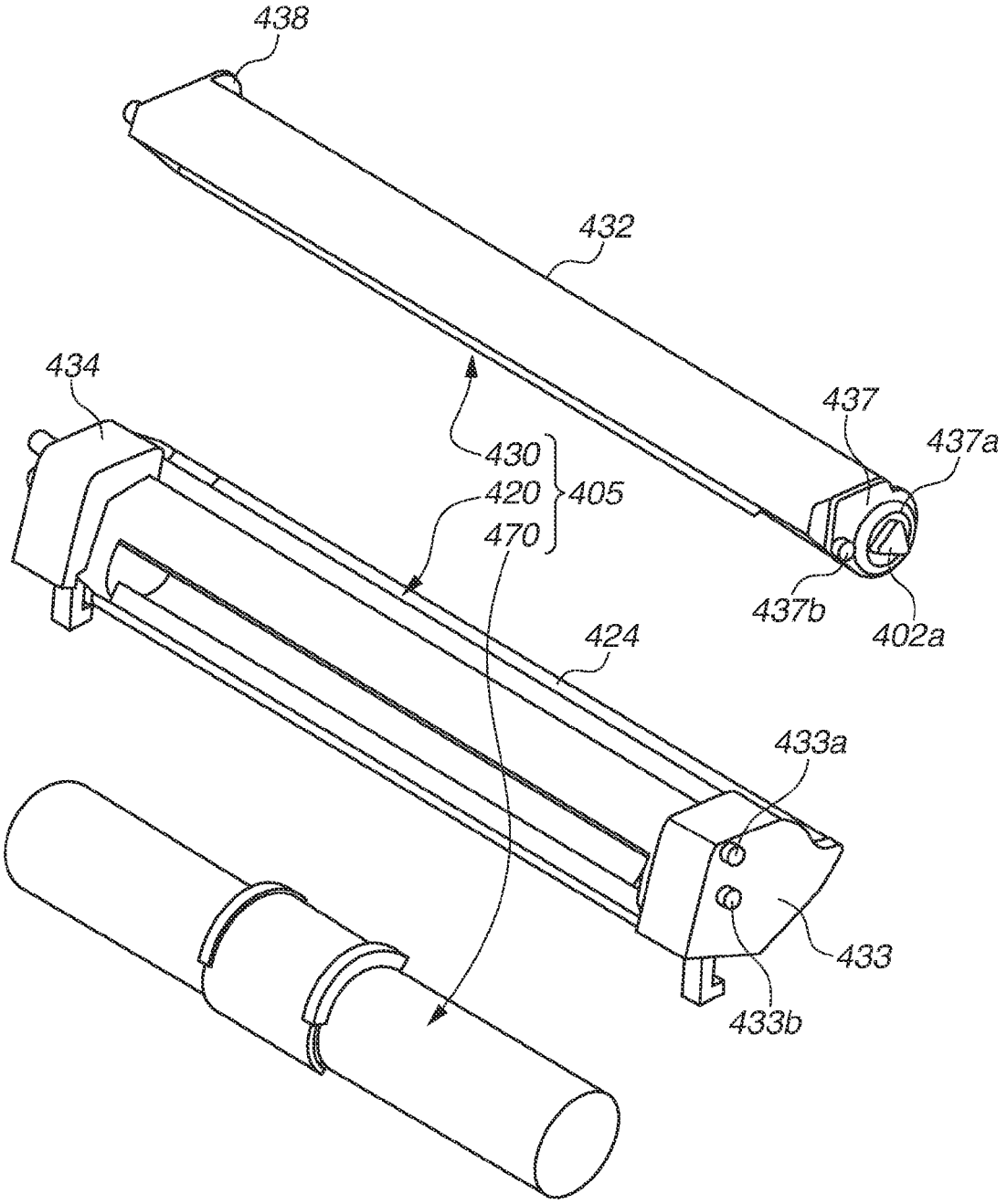
FIG. 24 is an exploded perspective view of the fourth cartridge group according to the second modification.

First, the fourth cartridge group 405 is described with reference to FIGS. 23 and 24. FIG. 23 is a schematic cross-sectional view of a configuration of the fourth cartridge group 405. FIG. 24 illustrates the drum cartridge 430, the developing cartridge 420, and the toner cartridge 470 of the fourth cartridge group 405. As illustrated in FIG. 23, the fourth cartridge group 405 includes the drum cartridge 430, the developing cartridge 420, and the toner cartridge 470. The drum cartridge 430 and the developing cartridge 420 are separated from each other and respectively detachably attachable to the apparatus main body 1A. On the other hand, the toner cartridge 470 is detachably attachable to the developing cartridge 420. The developing cartridge 420 including a developing roller 422 is swingably attached to the drum cartridge 430 including a photosensitive drum 402.

The drum cartridge 430 includes a cleaning frame 432, the photosensitive drum 402 (see FIG. 23), a drive side drum bearing 437, a non-drive side drum bearing 438, a charging roller 403, and a cleaning unit 431. The photosensitive drum 402 is rotatably attached to the cleaning frame 432 via the drive side drum bearing 437 and the non-drive side drum bearing 438. A drive input unit 402*a* disposed on one end of the photosensitive drum 402 in the longitudinal direction engages with the drive output unit (not illustrated) of the apparatus main body 1A and receives a driving force from the drive motor (not illustrated) of the apparatus main body 1A. Accordingly, the photosensitive drum 402 is driven to rotate to the direction of the arrow A in response to an image forming operation (see FIG. 23).

The developing cartridge 420 includes a developing frame 424, the developing roller 422, a drive side developing bearing 433, a non-drive side developing bearing 434, and a toner chamber 423 for storing the toner t as illustrated in FIGS. 23 and 24. The developing roller 422 is rotatably attached to the developing frame 424 via the drive side developing bearing 433 and the non-drive side developing bearing 434. The toner cartridge 470 can store the toner t and supply the toner t to the toner chamber 423 of the developing cartridge 420.

(Configuration of Guiding Unit)

Figure 25:
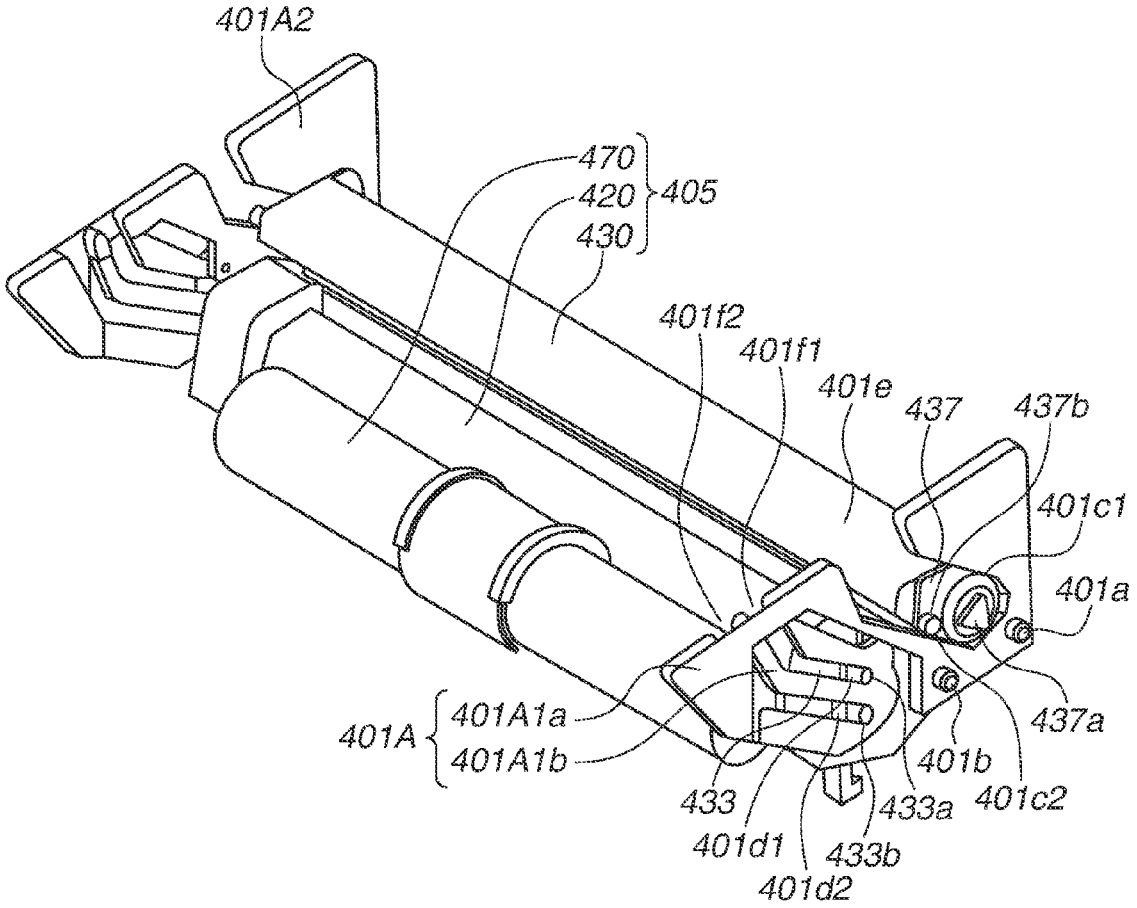
FIG. 25 is a perspective view of a fourth guide and the fourth cartridge group according to the second modification.
Figure 26:
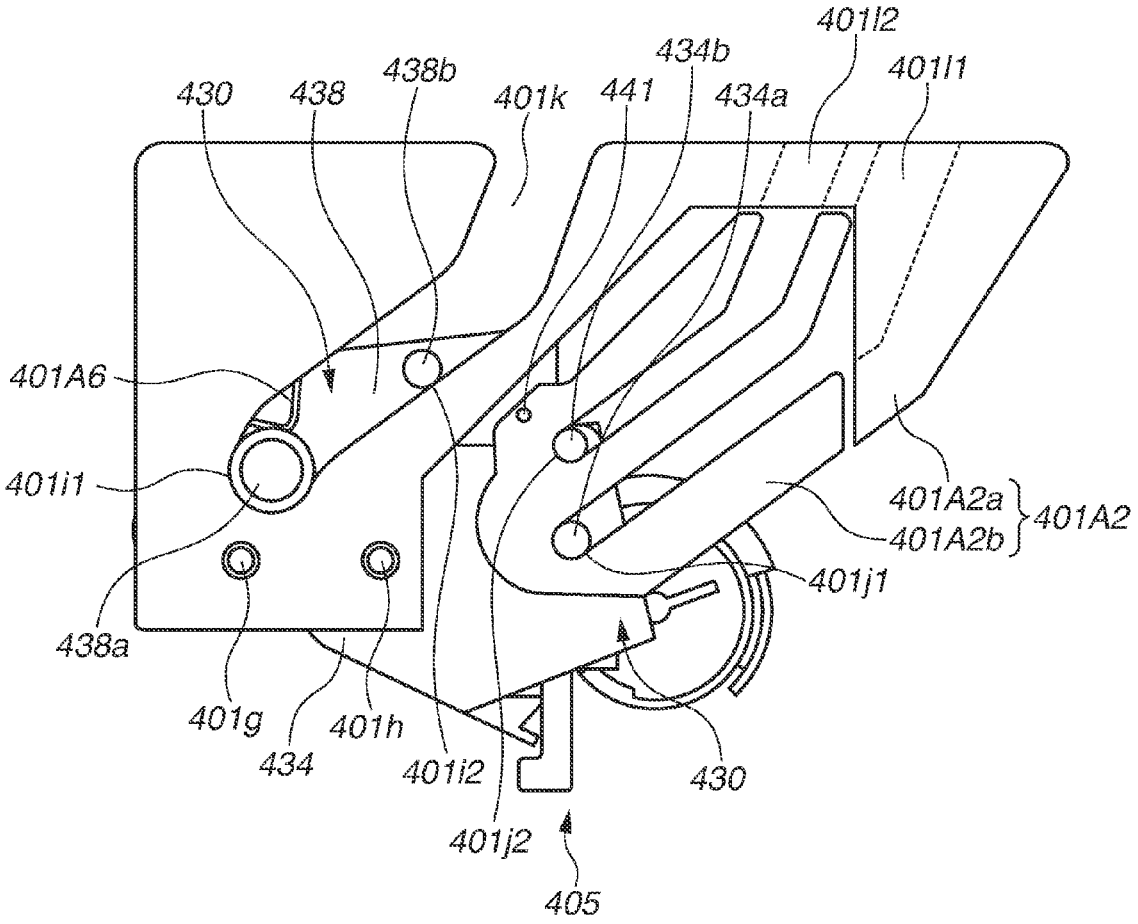
FIG. 26 is a side view of the fourth guide and the fourth cartridge group according to the second modification.
Figure 27:
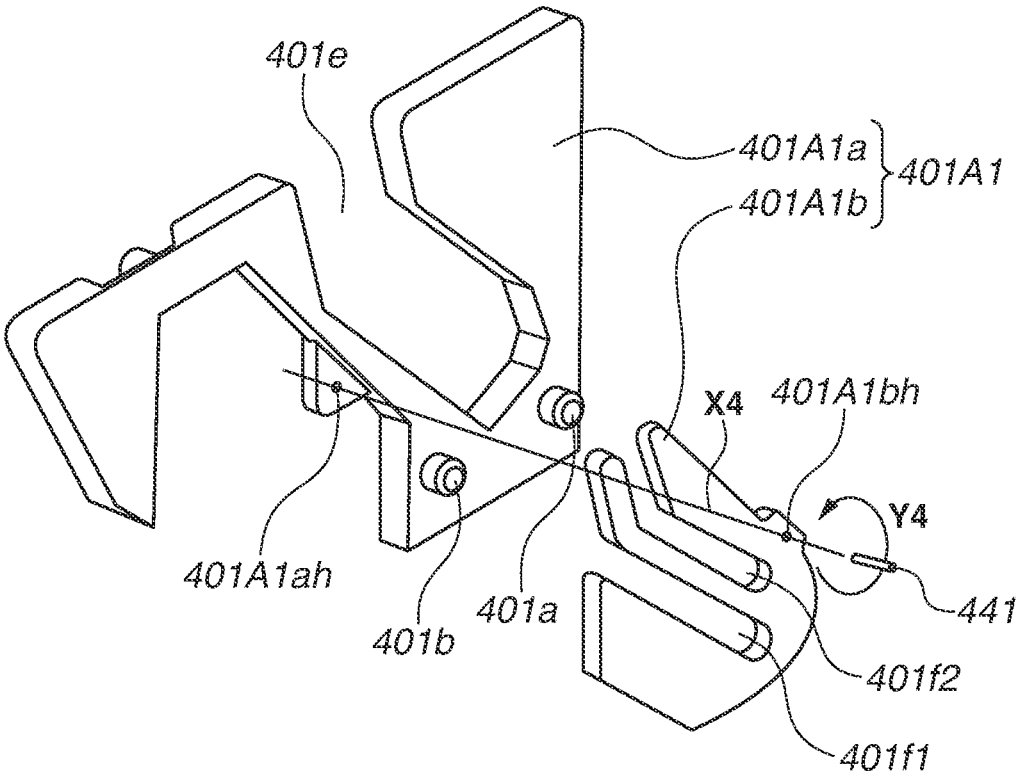
FIG. 27 is a perspective view of the fourth guide according to the second modification.

Next, the configuration of the guiding unit when the fourth cartridge group 405 is attached to and detached from the apparatus main body 1A is described with reference to FIGS. 25, 26, and 27. FIG. 25 is a perspective view of a state in which the fourth cartridge group 405 is guided by a drive side fourth guide 401A1 and a non-drive side first guide 1A2 and mounted to the apparatus main body 1A. FIG. 26 is a side view of the fourth cartridge group 405 and the non-drive side fourth guide 401A2 in a state in which the fourth cartridge group 405 is mounted to the apparatus main body 1A. FIG. 27 is an exploded view of the drive side fourth guide 401A1.

As illustrated in FIGS. 25 and 26, the guiding unit (the fourth guide) disposed to the apparatus main body 1A is constituted of the drive side fourth guide 401A1 and the non-drive side fourth guide 401A2. When the fourth cartridge group 405 is mounted to the apparatus main body 1A, the drive side fourth guide 401A1 is disposed so as to face the drive side drum bearing 437 and the drive side developing bearing 433. Similarly, the non-drive side fourth guide 401A2 is disposed so as to face the non-drive side drum bearing 438 and the non-drive side developing bearing 434.

The drive side fourth guide 401A1 is provided with a positioned portion 401*a* and a rotation regulated portion 401*b* which have protruded boss shapes and a drum guiding portion 401*e* and developing guiding portions 401*f*1 and 401*f*2 which have groove shapes (FIG. 25). On the other hand, on the drive side, the drive side side plate 1A4 of the apparatus main body 1A is provided with the positioning portion 1A4*a* and the rotation regulating portion 1A4*b* which have concave shapes, such as holes, as illustrated in FIG. 7A. The positioned portion 401*a* engages with the positioning portion 1A4*a*, and the rotation regulated portion 401*b* engages with the rotation regulating portion 1A4*b*, so that the drive side fourth guide 401A1 is supported by and fixed to the apparatus main body 1A.

The drive side fourth guide 401A1 fixed to the apparatus main body 1A is configured to guide the drum cartridge 430 and the developing cartridge 420 by the drum guiding portion 401*e* and the developing guiding portions 401*f*1 and 401*f*2 when these cartridges are mounted to the apparatus main body 1A. More specifically, the drive side drum bearing 437 is provided with a first guided portion 437*a* (the positioning portion) and a second guided portion 437*b* (the rotation regulating portion) which are formed so as to include a bearing portion of the photosensitive drum 402 and configured to engage with the drum guiding portion 401*e*. In addition, the drive side developing bearing 433 is provided with a first developing guided portion 433*a* (the engagement portion) and a second developing guided portion 433*b* (the rotation regulating portion). The first developing guided portion 433*a* is configured to engage with the developing guiding portion 401*f*1, and the second developing guided portion 433*b* is configured to engage with the developing guiding portion 401*f*2. Accordingly, at the mounting position, a drive side drum positioning portion 401*c*1 for positioning the first guided portion 437*a* and a drive side drum rotation regulating portion 401*c*2 for regulating the rotation of the second guided portion 437*b* regulate movement of the drum cartridge 430. Further, at the mounting position, a drive side developing positioning portion 401*d*1 for positioning the first developing guided portion 433*a* and a drive side developing rotation regulating portion 401*d*2 for regulating the rotation of the second developing guided portion 433*b* regulate movement of the developing cartridge 420.

The drive side fourth guide 401A1 is constituted of a fixed guide 401A1*a* and a movable guide 401A1*b* as illustrated in FIG. 27. The fixed guide 401A1*a* is provided with a supporting hole 401A1*ah*, the movable guide 401A1*b* is provided with a supporting hole 401A1*bh*, and a rotation shaft 441 is inserted into the supporting hole 401A1*ah* and the supporting hole 401A1*bh*. Accordingly, the movable guide 401A1*b* is supported to be rotatable in a Y4 direction centering on a rotation axis line X4 with respect to the fixed guide 401A1*a*. The fixed guide 401A1*a* is provided with the positioned portion 401*a* and the rotation regulated portion 401*b* in addition to the drum guiding portion 401*e*, and the movable guide 401A1*b* is provided with the developing guiding portions 401*f*1 and 401*f*2. Thus, the positioned portion 401*a* engages with the positioning portion 1A4*a*, and the rotation regulated portion 401*b* engages with the rotation regulating portion 1A4*b*, so that the fixed guide 401A1*a* is supported by and fixed to the apparatus main body 1A. Accordingly, the movable guide 401A1*b* is configured to be movable with respect to the fixed guide 401A1*a*, and positions of the developing guiding portions 401*f*1 and 401*f*2 can be changed without changing a position of the drum guiding portion 401*e*.

Similar to the drive side fourth guide 401A1, the non-drive side fourth guide 401A2 is provided with a positioned portion 401*g* and a rotation regulated portion 401*h* which have protruded boss shapes and a drum guiding portion 401*k* and developing guiding portions 401*l*1 and 401*l*2 which have groove shapes (FIG. 26). On the other hand, on the non-drive side, the non-drive side side plate 1A5 of the apparatus main body 1A is provided with the positioning portion 1A5*a* and the rotation regulating portion 1A5*b* which have concave shapes, such as holes, as illustrated in FIG. 7B. The positioned portion 401*g* engages with the positioning portion 1A5*a*, and the rotation regulated portion 401*h* engages with the rotation regulating portion 1A5*b*, so that the non-drive side fourth guide 401A2 is supported by and fixed to the apparatus main body 1A.

The non-drive side fourth guide 401A2 fixed to the apparatus main body 1A is configured to guide the drum cartridge 430 and the developing cartridge 420 by the drum guiding portion 401*k* and the developing guiding portions 401*l*1 and 401*l*2 when these cartridges are mounted to the apparatus main body 1A. More specifically, the non-drive side drum bearing 438 is provided with a third guided portion 438*a* (the positioning portion) and a fourth guided portion 438*b* (the rotation regulating portion) which are formed so as to include the bearing portion of the photosensitive drum 402 and configured to engage with the drum guiding portion 401*k*. In addition, the non-drive side developing bearing 434 is provided with a third developing guided portion 434*a* (the engagement portion) and a fourth developing guided portion 434*b* (the rotation regulating portion). The third developing guided portion 434*a* is configured to engage with the developing guiding portion 401*l*1, and the fourth developing guided portion 434*b* is configured to engage with the developing guiding portion 401*l*2. A spring 401A6 urges the third guided portion 438*a* toward a drive side drum positioning portion 401*i*1 and urges the fourth guided portion 438*b* toward a drive side drum rotation regulating portion 401*i*2 so as to regulate the movement of the drum cartridge 430 from the mounting position. Similarly, the spring, not illustrated, urges the third developing guided portion 434*a* toward a drive side developing positioning portion 401*j*1 and urges the fourth developing guided portion 434*b* toward a drive side developing rotation regulating portion 401*j*2 so as to regulate the movement of the developing cartridge 420 from the mounting position.

The non-drive side fourth guide 401A2 is also constituted of a fixed guide 401A2*a* and a movable guide 401A2*b*. Similar to the drive side fourth guide 401A1, the fixed guide 401A2*a* and the movable guide 401A2*b* are supported to be rotatable in the Y4 direction centering on the rotation axis line X4. The fixed guide 401A2*a* is provided with the positioned portion 401*g* and the rotation regulated portion 401*h* in addition to the drum guiding portion 401*k*, and the movable guide 401A2*b* is provided with the developing guiding portions 401*l*1 and 401*l*2. Thus, the positioned portion 401*g* engages with the positioning portion 1A5*a*, and the rotation regulated portion 401*h* engages with the rotation regulating portion 1A5*b*, so that the fixed guide 401A2*a* is supported by and fixed to the apparatus main body 1A. Accordingly, the movable guide 401A2*b* is configured to be movable with respect to the fixed guide 401A2*a*, and positions of the developing guiding portions 401*l*1 and 401*l*2 can be changed without changing a position of the drum guiding portion 401*k*.

(Abutment and Separation Method)

Next, abutment and separation of the photosensitive drum 402 and the developing roller 422 of the fourth cartridge group 405 is described. The method is similar to the method for abutting the photosensitive drum 202 against the developing roller 222 in the second cartridge group 205. More specifically, when a job signal is input to the apparatus main body 1A, the pressing lever 40 of the apparatus main body 1A is urged to the direction of the arrow B. The pressing lever 40 urges the pressed member rotatably supported by the developing unit 420. Accordingly, the developing unit 420 rotates in the Y4 direction centering on the movable guide rotation shaft 441 (the rotation axis line X4) together with the movable guide 401A1*b*, and the developing roller 422 abuts against the photosensitive drum 402. Accordingly, a toner image can be formed on the photosensitive drum 402. Similar to the above description, when image forming is complete, the pressing lever 40 is released from urging in the direction of the arrow B, and the developing roller 422 and the photosensitive drum 402 can be shifted from the abutting state to the separated state.

As described above, in the drum cartridge 430, the first guided portion 437*a* and the third guided portion 438*a* to be the positioning portions are formed so as to include the bearing portion of the photosensitive drum 402, and the second guided portion 437*b* and the fourth guided portion

438*b* are disposed on different places as the rotation regulating portions. Further, the rotation axis line X4 of the movable guide 401A1*b* to the fixed guide 401A1*a* is disposed on a same line as the first cartridge group 5 and the like. Accordingly, the fourth cartridge group 405 is detachably attachable to the apparatus main body 1A, and the abutment and separation of the developing roller 322 and the photosensitive drum 302 can be performed. As described above, the image forming apparatus is provided which can change a configuration so as to be detachably attachable a different cartridge by only changing the guiding unit while maintaining a part related to image forming the same. Further, when the configuration of the fourth cartridge group 405 is adopted, it is not necessary to change the mechanism related to the abutment and separation of the photosensitive drum and the developing roller according to the apparatus main body, and the form of the cartridge can be easily changed.

According to the above-described exemplary embodiment and modifications, the configuration includes the positioning portion and the rotation regulating portion, however, the configuration is not limited to the ones described above. For example, the positioning portion may be a polygon which does not rotate in a groove shape guiding portion, and the rotation regulating portion may not be provided. Similarly, the configuration is not limited to the above-described ones which include the engagement portion and the rotation regulating portion. For example, the engagement portion may be a polygon which does not rotate in a groove shape guiding portion, and the rotation regulating portion may not be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-022677, filed Feb. 6, 2015, which is hereby incorporated by reference herein in its entirety.

What is claimed is:

1. A main body of an image forming apparatus selectively detachably attachable a first cartridge group and a second cartridge group thereto, wherein the first cartridge group comprises a first drum cartridge including a first photosensitive drum and a first developing cartridge which is a separate body from the first drum cartridge and includes a first developing roller, and the second cartridge group comprises a second drum cartridge including a second photosensitive drum and a second developing cartridge which is a separate body from the second drum cartridge and includes a second developing roller, wherein the main body of the image forming apparatus comprises an exposure unit configured to form an electrostatic latent image on the first photosensitive drum or the second photosensitive drum, and wherein a first guide configured to position the first cartridge group to the main body of the image forming apparatus and a second guide configured to position the second cartridge group to the main body of the image forming apparatus are selectively detachable and attachable to the main body of the image forming apparatus.

2. The main body of the image forming apparatus according to claim 1, wherein the first guide engages with a first positioning portion provided on a first bearing of the first drum cartridge supporting the first photosensitive drum to position the first cartridge group to the main body of the image forming apparatus, and wherein the second guide engages with a second positioning portion provided on a second bearing of the second drum cartridge supporting the second photosensitive drum to position the second cartridge group to the main body of the image forming apparatus.

3. The main body of the image forming apparatus according to claim 2, wherein, in the first guide, a first fixed guide which is provided with a first drum guiding portion for engaging with the first positioning portion and fixed to the main body of the image forming apparatus and a first movable guide which is provided with a first developing guiding portion for engaging with a first engagement portion of the first developing cartridge are rotatably arranged by a first rotation shaft, and wherein, in the second guide, a second fixed guide which is provided with a second drum guiding portion for engaging with the second positioning portion and fixed to the main body of the image forming apparatus and a second movable guide which is provided with a second developing guiding portion for engaging with a second engagement portion of the second developing cartridge are rotatably arranged by a second rotation shaft.

4. The main body of the image forming apparatus according to claim 3, wherein the first guide and the second guide are configured to be mountable so that the first rotation shaft and the second rotation shaft are on a same line in the main body of the image forming apparatus.

5. The main body of the image forming apparatus according to claim 1, wherein the first cartridge group is capable of attaching and detaching a toner cartridge for storing a toner to and from the first developing cartridge.

6. The main body of the image forming apparatus according to claim 1, wherein the second cartridge group is capable of attaching and detaching a toner cartridge for storing a toner to and from the second developing cartridge.

7. A main body of an image forming apparatus selectively detachably attachable a second cartridge group and a third cartridge group thereto, wherein the second cartridge group comprises a second drum cartridge including a second photosensitive drum and a second developing cartridge which is a separate body from the second drum cartridge and includes a second developing roller, and the third cartridge group comprises a first process cartridge in which a first photosensitive member unit including a third photosensitive drum and a first developing unit including a third developing roller are unified, wherein the main body of the image forming apparatus comprises an exposure unit configured to form an electrostatic latent image on the second photosensitive drum or the third photosensitive drum, and wherein a second guide configured to position the second cartridge group to the main body of the image forming apparatus and a third guide configured to position the third cartridge group to the main body of the image forming apparatus are selectively detachable and attachable to the main body of the image forming apparatus.

8. The main body of the image forming apparatus according to claim 7, wherein the second guide engages with a second positioning portion provided on a second bearing supporting the second photosensitive drum to position the second cartridge group to the main body of the image forming apparatus, and wherein the third guide engages with a third positioning portion provided on a third bearing supporting the third photosensitive drum to position the third cartridge group to the main body of the image forming apparatus.

9. The main body of the image forming apparatus according to claim 8, wherein the first process cartridge enables at least one of abutment and separation between the third photosensitive drum and the third developing roller by rotating by a third rotation shaft, the second guide is provided with a second drum guiding portion engaging with the second positioning portion, and in the second guide, a second fixed guide fixed to the main body of the image forming apparatus and a second movable guide provided with a second developing guiding portion engaging with a second engagement portion of the second cartridge group are rotatably arranged by a second rotation shaft, and wherein the third guide is provided with a third drum guiding portion engaging with the third positioning portion and a third developing guiding portion engaging with a third engagement portion of the third cartridge group.

10. The main body of the image forming apparatus according to claim 9, wherein the second guide and the third guide are configured to be mountable so that the second rotation shaft and the third rotation shaft are on a same line in the main body of the image forming apparatus.

11. The main body of the image forming apparatus according to claim 7, wherein the second cartridge group is capable of attaching and detaching a toner cartridge for storing a toner to and from the second developing cartridge.

12. A main body of an image forming apparatus selectively detachably attachable a third cartridge group and a fourth cartridge group thereto, wherein the third cartridge group comprises a first process cartridge in which a first photosensitive member unit including a third photosensitive drum and a first developing unit including a third developing roller are unified so as to enable at least one of abutment and separation between the third photosensitive drum and the third developing roller by rotating by a third rotation shaft, and the fourth cartridge group comprises a second process cartridge in which a second photosensitive member unit including a fourth photosensitive drum and a second developing unit including a fourth developing roller are unified so as to enable at least one of abutment and separation between the fourth photosensitive drum and the fourth developing roller by rotating by a fourth rotation shaft, wherein the main body of the image forming apparatus comprises an exposure unit configured to form an electrostatic latent image on the third photosensitive drum or the fourth photosensitive drum, wherein a third guide which is provided with a third drum guiding portion engaging with a third positioning portion provided on a third bearing supporting the third photosensitive drum and a third developing guiding portion engaging with a third engagement portion of the first developing unit and fixed to the main body of the image forming apparatus and a fourth guide which is provided with a fourth drum guiding portion engaging with a fourth positioning portion provided on a fourth bearing supporting the fourth photosensitive drum and a fourth developing guiding portion engaging with a fourth engagement portion of the second developing unit and fixed to the main body of the image forming apparatus are selectively detachable and attachable to the main body of the image forming apparatus, and wherein the third guide and the fourth guide are configured to be mountable so that the third rotation shaft and the fourth rotation shaft are on a same line in the main body of the image forming apparatus.

13. The main body of the image forming apparatus according to claim 12, wherein the third cartridge group is capable of attaching and detaching a toner cartridge for storing a toner to and from the first developing cartridge.

14. The main body of the image forming apparatus according to claim 12, wherein the fourth cartridge group is capable of attaching and detaching a toner cartridge for storing a toner to and from the second developing cartridge.

* * * * *